US011305315B2

(12) United States Patent
Tufford

(10) Patent No.: US 11,305,315 B2
(45) Date of Patent: Apr. 19, 2022

(54) VIBRATORY CLASSIFIER APPARATUS

(71) Applicant: Superior Industries, Inc., Morris, MN (US)

(72) Inventor: Cody Tufford, Lansing, MI (US)

(73) Assignee: Superior Industries, Inc., Morris, MN (US)

( * ) Notice: Subject to any disclaimer, the term of this patent is extended or adjusted under 35 U.S.C. 154(b) by 0 days.

(21) Appl. No.: 17/126,495

(22) Filed: Dec. 18, 2020

(65) Prior Publication Data

US 2021/0101180 A1 Apr. 8, 2021

Related U.S. Application Data

(63) Continuation of application No. 16/154,913, filed on Oct. 9, 2018, now abandoned, which is a continuation of application No. 15/453,018, filed on Mar. 8, 2017, now Pat. No. 10,118,198.

(60) Provisional application No. 62/410,660, filed on Oct. 20, 2016, provisional application No. 62/372,563, filed on Aug. 9, 2016, provisional application No. 62/332,180, filed on May 5, 2016, provisional application No. 62/305,810, filed on Mar. 9, 2016.

(51) Int. Cl.

| | |
|---|---|
| ***B07B 1/46*** | (2006.01) |
| ***B07B 1/42*** | (2006.01) |
| ***B07B 1/55*** | (2006.01) |

(52) U.S. Cl.

CPC ..... *B07B 1/46* (2013.01); *B07B 1/42* (2013.01); *B07B 1/55* (2013.01); *B07B 2230/01* (2013.01)

(58) Field of Classification Search

CPC .... B07B 1/42; B07B 1/46; B07B 1/55; B07B 2230/01

USPC ..... 209/269

See application file for complete search history.

(56) References Cited

U.S. PATENT DOCUMENTS

| | | | | |
|---|---|---|---|---|
| 2,601,490 A * | 6/1952 | Bailey | A23N 5/008 83/417 |
| 5,337,901 A * | 8/1994 | Skaer | B07B 1/28 209/314 |
| 5,501,343 A * | 3/1996 | Hadden | B07B 1/46 209/240 |
| 10,926,294 B2 * | 2/2021 | Felton | B07B 1/36 |
| 11,020,768 B2 * | 6/2021 | Grimm | B07B 1/16 |
| 2015/0217217 A1 * | 8/2015 | Convery | B07B 1/28 210/388 |
| 2017/0259302 A1 * | 9/2017 | Erickson | B07B 1/46 |

FOREIGN PATENT DOCUMENTS

| | | | |
|---|---|---|---|
| WO | WO-9605918 A1 * | 2/1996 | B65G 47/20 |

* cited by examiner

*Primary Examiner* — Terrell H Matthews

(74) *Attorney, Agent, or Firm* — Dicke, Billig & Czaja, PLLC

(57) ABSTRACT

Vibratory classifier apparatus are provided, e.g., for classification of materials such as wet or dry aggregate materials. In some embodiments, a drive system of the vibratory classifier apparatus includes a housing that can optionally be modified to allow access to a belt or other components of the drive system.

12 Claims, 26 Drawing Sheets

700

VIBRATORY CLASSIFIER APPARATUS

CROSS REFERENCE TO RELATED APPLICATIONS

This is a continuation of U.S. patent application Ser. No. 16/154,913, filed Oct. 9, 2018, which is a continuation of U.S. patent application Ser. No. 15/453,018, filed Mar. 8, 2017, now U.S. Pat. No. 10,118,198, which claims the benefit of U.S. Provisional Patent Application Ser. No. 62/305,810, filed Mar. 9, 2016, U.S. Provisional Patent Application Ser. No. 62/332,180, filed May 5, 2016, U.S. Provisional Patent Application Ser. No. 62/372,563, filed Aug. 9, 2016, and U.S. Provisional Patent Application Ser. No. 62/410,660, filed Oct. 20, 2016, which are incorporated by reference herein.

BACKGROUND

Vibratory classifiers (such as vibratory horizontal and incline screens and grizzly feeders) use vibration to classify materials such as wet or dry aggregate materials. Commonly vibratory classifiers consist of one or more screens supported by sidewalls, which are mounted on a stationary base.

There is a need for an improving a vibrating classifier having improved features for operation, maintenance and/or adjustment.

DETAILED DESCRIPTION

Unless otherwise defined, terms used herein have the meaning commonly understood by one of ordinary skill in the art to which this disclosure is relevant. The terminology used herein is for the purpose of describing particular example embodiments and is not intended to be limiting. The method steps, processes, and operations described herein are not to be construed as necessarily requiring their performance in the order discussed or illustrated, and it should be appreciated that that additional or alternative steps may be employed. It should be appreciated that various directions such as "rearward," "forward," "upper," "lower" and so forth are made with respect to explanation in conjunction with the drawings, and that components may be oriented differently in various embodiments, including during operation, transportation and manufacturing. Where an object, element or component may be described herein as being on, coupled to, operatively coupled to, engaged with another object, element or component, such interrelation may be direct and/or intervening objects, elements or components can be present. The term "and/or" is used herein to disclose any and all combinations of one or more of the associated listed items.

Figure 1:
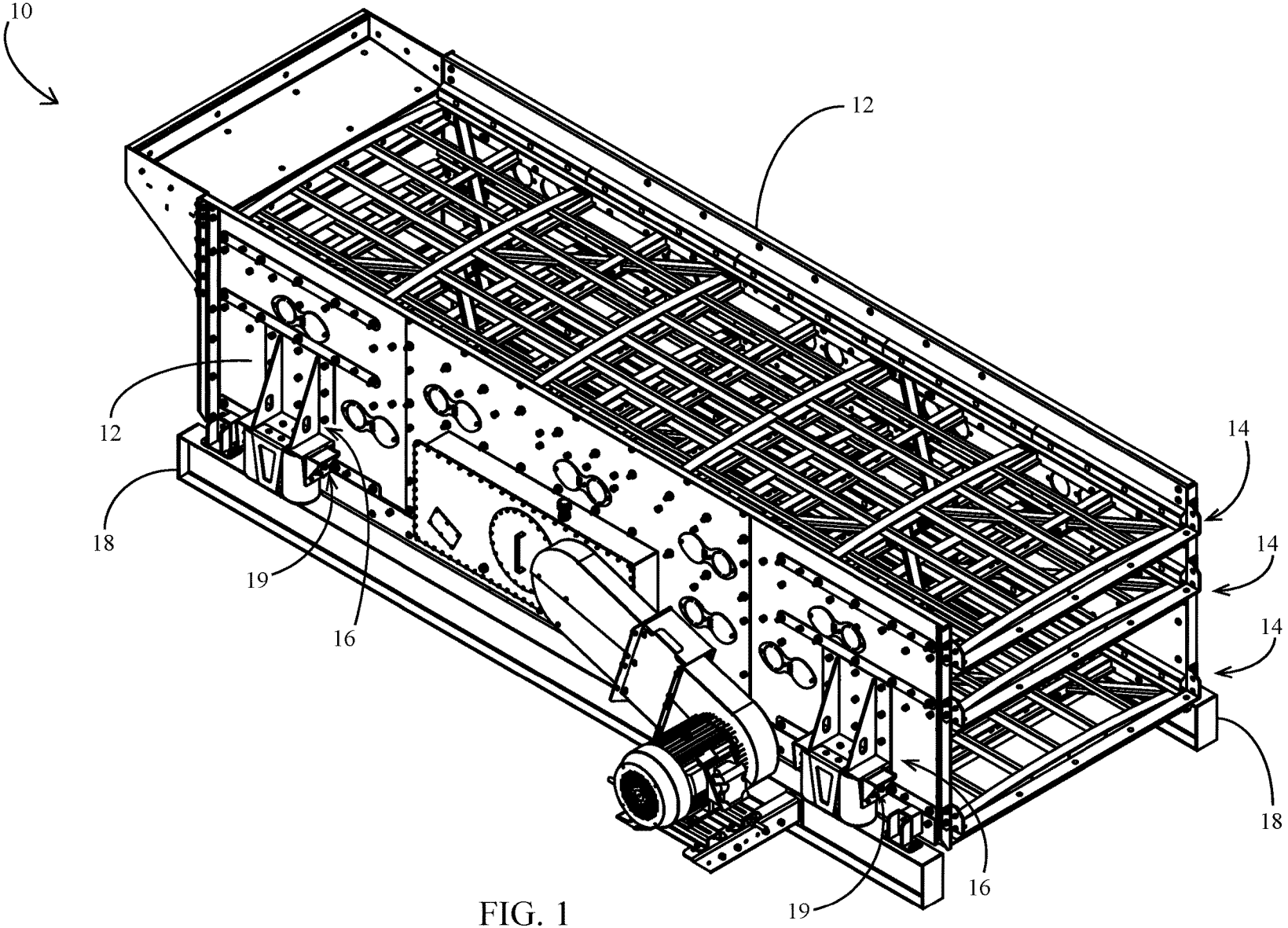
FIG. 1 is a perspective view of an embodiment of a vibratory screen with one embodiment of a support for use in lifting or supporting the vibratory screen above a stationary base.

Referring to the drawings, wherein like reference numerals designate identical or corresponding parts throughout the several views, FIG. 1 is a perspective view of an embodiment of a vibratory screen 10 for classifying loose material, such as aggregate. The vibratory screen 10 is comprised of a pair of sidewalls 12 and a plurality of screens 14 supported between sidewalls 12. In some embodiments, each of the sidewalls 12 optionally include a pair of spring suspension systems 16 near each end of the vibratory screen that dampens vibrations of the vibratory screen from a stationary base 18, which may comprise a dedicated structure as illustrated or an exposed surface such as the ground. In general, vibratory screen 10 optionally includes one embodiment of a support structure 19 with a weight-bearing surface on the sidewall of the vibratory screen in the vicinity of the suspension system 16. The added support structure 19 is optionally capable of supporting the weight of at least a portion of the vibratory screen 10 above the stationary base 18 at a sufficient distance to allow removal and/or replacement of springs of the suspension system. As will be disclosed below in more detail, in some embodiments the added support structure 19 also permits a separating mechanism (e.g., a lifting device such as a lift jack) to engage a support surface of the structure to separate the vibratory screen from the stationary base (e.g., by elevating the vibratory screen above the stationary base) sufficiently to remove and replace a spring of the suspension system.

Figure 2:
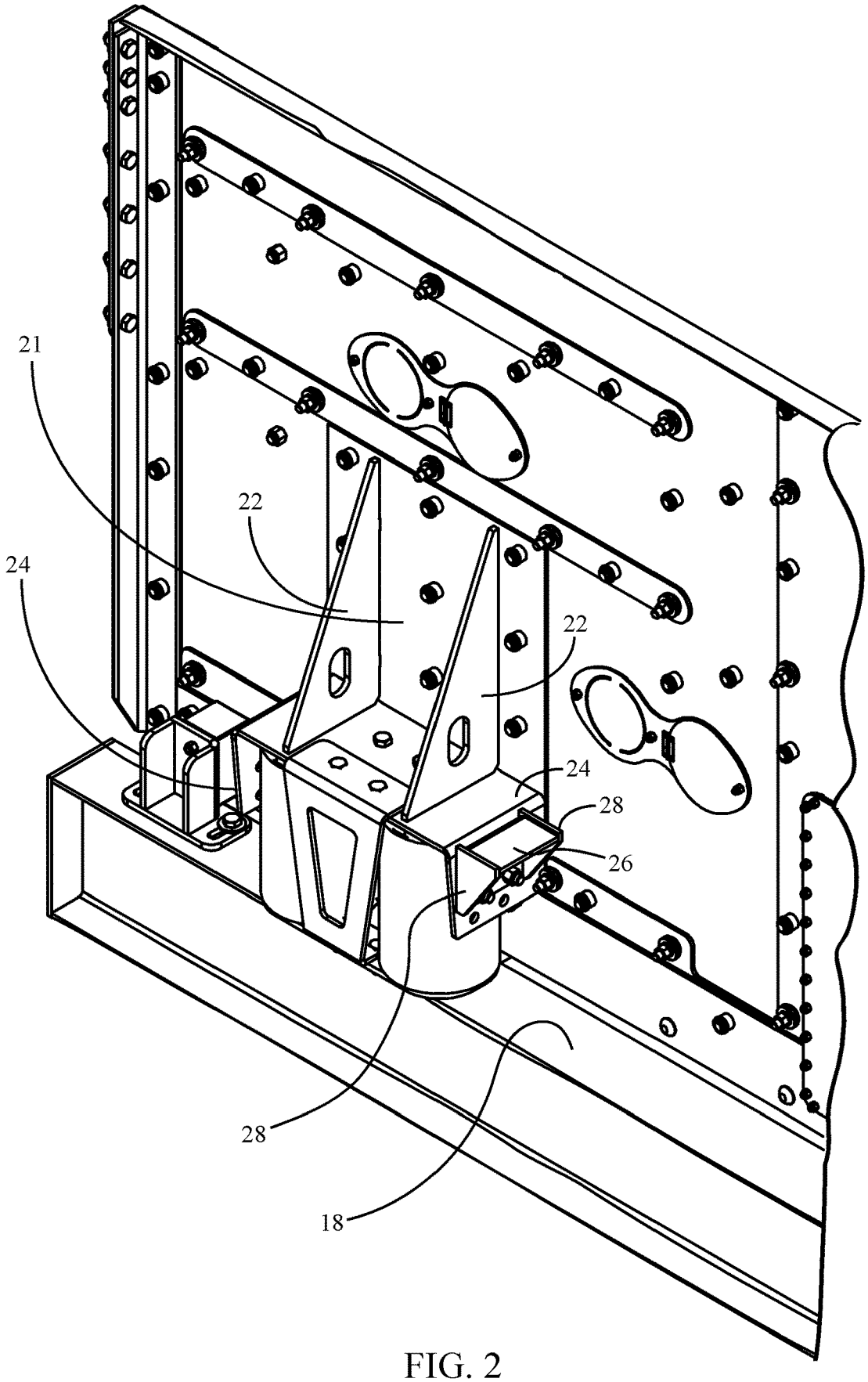
FIG. 2 is an enlarged perspective view of the lift support embodiment shown in FIG. 1.

As shown in FIG. 2, in some embodiments the support structure 19 can be incorporated with a typical suspension system that includes a horizontal metal plate 20 that is mounted on the sidewall 12 and is supported with one or more support brackets or gussets 22 that are connected to the metal plate 20 and the sidewall 12. Typical of suspensions systems for vibratory screens, metal plate 20 optionally rests on one or more springs that are positioned between the metal plate 20 and the stationary base 18. Sidewall 12 may be reinforced with metal plates, brackets, or other metal members, such as metal plate 21, for mounting, for example, suspension system 16 to sidewall 12. The horizontal plate 20 optionally rests on one or more steel springs supported on the stationary base 18.

As further shown in FIG. 2, in some embodiments, the horizontal metal plate 20 is formed with one or more end plates 24 that are generally perpendicular to the horizontal plate 20. End plates 24 may be integrally connected to horizontal metal plate 20, or may alternatively be connected to metal plate 20 by welding or other mechanical connection, e.g., by bolting. In the embodiment shown in FIG. 1, the one or more end plates 24 are optionally oriented downward toward the stationary base 18. Alternatively end plates 24 can be oriented in an upward direction opposite the stationary base 18. In some embodiments, end plates 24 may further be secured to the sidewall 12, such as by welding or other mechanical connection.

Optionally secured to one of the end plates 24 is one embodiment of a support structure 19 that is comprised of a generally horizontal metal plate 26 that extends generally perpendicularly from the end plate 24, generally in a direction away from the springs. In some embodiments, the horizontal metal plate 26 is formed from an L-shaped metal plate, with the vertical leg of the plate connected to the end plate 24 by bolts or welding. Alternatively, the horizontal metal plate is welded directly to the end plate 24. Plate 26 may further be supported by one or more support plates or gussets 28 that are secured to the end plate 24 and the metal plate 26, such as by welding. The metal plate 26 is optionally generally parallel to a stationary base 18.

In general, metal plate 26 optionally forms a generally horizontal bearing surface capable of supporting the weight of a portion the vibratory screen above the stationary base. Alternatively or additionally, metal plate 26 provides a structure that permits the vibratory screen to be raised and lowered, such as by a lift jack, in the event a spring of the suspension system requires replacing. A lift jack may be supported directly or indirectly on the stationary base 18 or other suitable stationary structure with the lifting actuator of the lift jack positioned beneath the metal plate 26. The metal plate 26 optionally accommodates various types of pneumatic, hydraulic, electric and mechanical lift jacks with screw, cylinder, or ratchet type actuators. Non-limiting examples of such lift jacks includes bottle jacks, screw jacks, or farm jacks. These types of jacks also may be relatively inexpensive and easily operated by a single person to raise and lower the jack in a quick yet controlled manner. In some embodiments, the lift jack support therefore eliminates the need for heavy lifting equipment and lift equipment operators to replace a spring of the suspension system.

Figure 5:
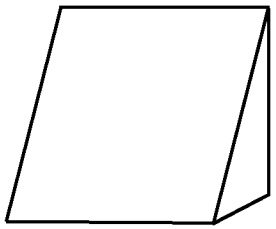
FIG. 5 is a diagrammatic view of a fourth embodiment of a lift support.
Figure 4:
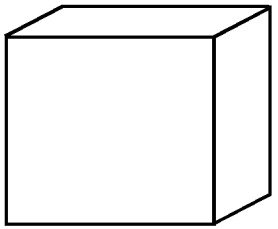
FIG. 4 is a diagrammatic view of a third embodiment of a lift support.
Figure 6:
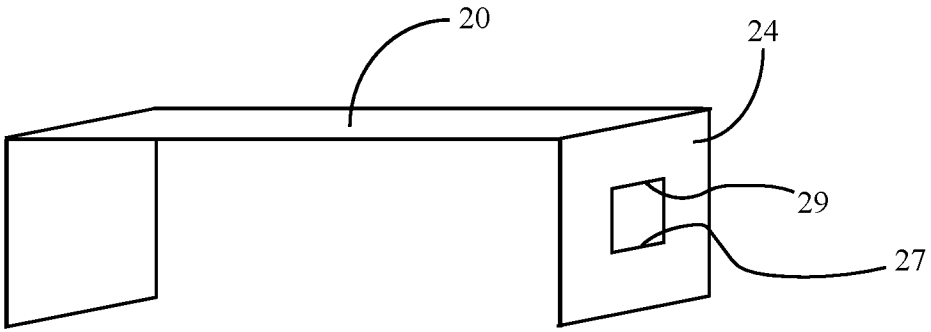
FIG. 6 is a diagrammatic view of a fifth embodiment of a lift support.

In an alternative embodiment, a support structure is optionally created by a metal block (FIG. 4) connected to end plate 24 such as be welding or a mechanical connection, e.g. by bolts, to create the bearing surface for a lift jack. In yet a further embodiment, a metal wedge (FIG. 5) can be connected to end plate 24, with the base of the wedge forming the bearing surface for a lift jack. In yet another embodiment, end plate 24' (FIG. 6) is formed with an opening 27, the upper edge 29 of which creates a bearing surface for a lift jack.

Figure 3:
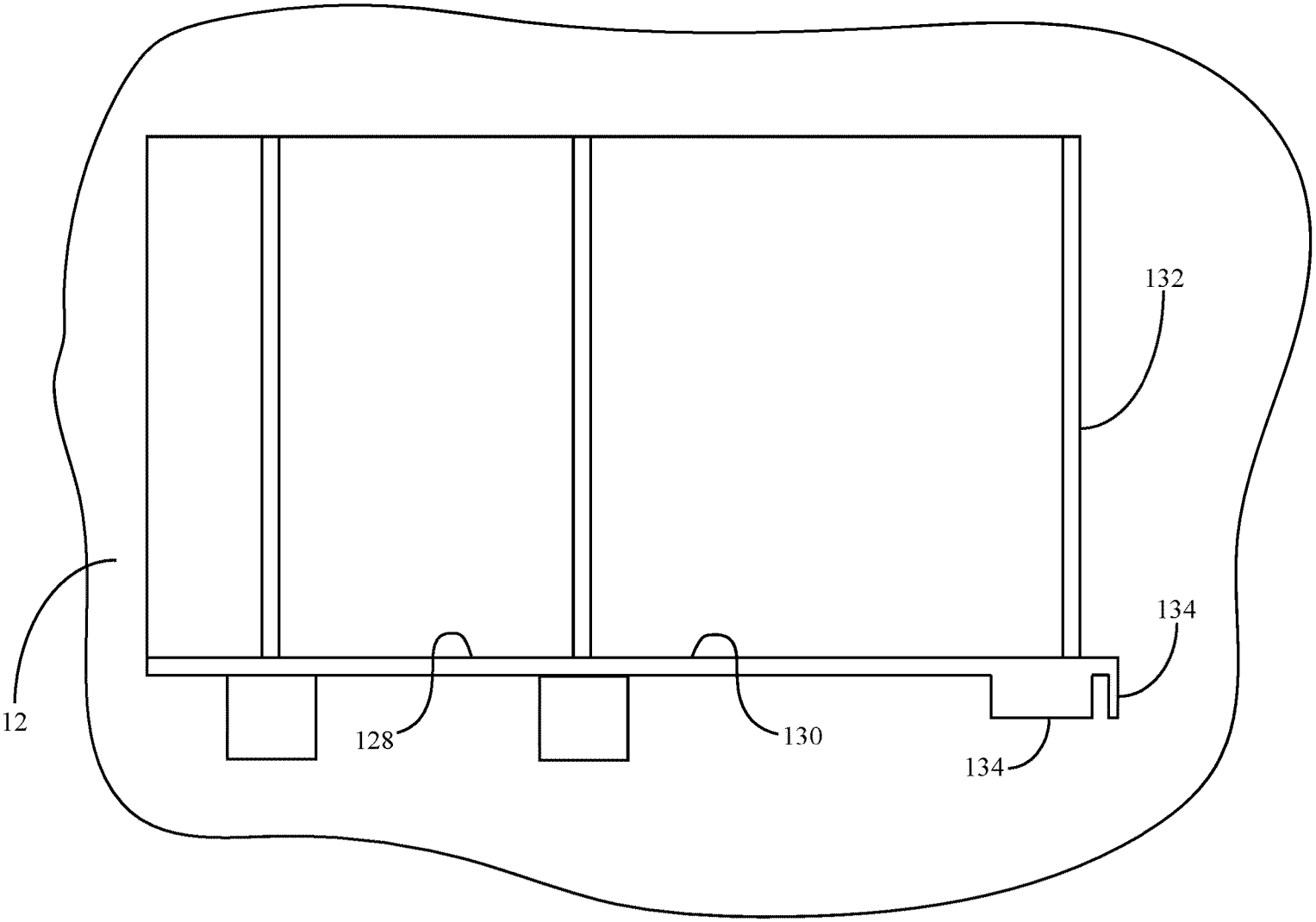
FIG. 3 is a side elevation view of a second embodiment of a lift support.

As shown in FIG. 3, in an alternate embodiment, the horizontal metal plate 128 of the suspension system that rests on the springs includes a plate extension 130 that extends from one end of metal plate 128. In one embodiment, the plate extension 130 is integrally formed with metal plate 128. Alternatively, the plate extension 130 can be connected to metal plate 128 by welding or a mechanical connection. The plate extension 130 may also be connected to the sidewall 12 and supported by one or more gusset plates 132 that are secured to sidewall 12. In one embodiment, the plate extension 130 may include one or more downturned ears 134 connected to the outer end and side edges of the plate extension 130 to aid in limiting movement of the lift jack.

In a further alternate embodiment, a support structure can be attached to the sidewall 12 of the vibratory screen at or near, but separate from, the suspension system. In one embodiment, the support structure can be formed from a metal plate and connected to and supported relative to the vibratory screen sidewall in a manner similar to the prior embodiments. Alternatively the support structure may comprise a metal block (FIG. 4) secured to the vibratory screen sidewall, with a lower generally horizontal surface of the block serving as a surface against which a lift jack may exert a lifting force. In yet a further alternate embodiment, a support structure may comprise a metal wedge (FIG. 5) secured to the vibratory screen wall with a lower generally horizontal surface serving as a lifting surface for a lift jack. In another embodiment, a metal plate having an opening like opening 27 of end plate 24 (FIG. 6) is secured to sidewall 12 with the upper edge 29 serving as a lifting surface for a lift jack.

It should be appreciated that in some embodiments of the vibratory screen 10, the separation direction (e.g., the direction of relative motion between the vibratory screen 10 and the stationary base 18 when the screen is displaced for maintenance or inspection purposes) may be along any direction including a non-vertical direction (e.g., an angle with respect to a vertical plane between 0 and 90 degrees such as 30 degrees, 45 degrees, or 60 degrees). For example, the separating mechanism (e.g., a lifting device such as a lift jack) and/or one or more springs supporting the vibratory screen 10 may be oriented in a non-vertical direction (e.g., the springs may have a direction of compression oriented in such non-vertical direction). In such embodiments among others, the metal plate 26 is optionally disposed at an angle other than generally horizontal; for example, the metal plate 26 may be disposed at an angle normal to the separation direction. In fact, it should be appreciated that in any of the embodiments disclosed herein, metal plate 26 or other bearing surface of the support structure 19 may be disposed generally normal to (e.g., normal to, approximately normal to) the separation direction.

According to some embodiments, a vibratory screen has been disclosed that includes a support structure on a structure of the screen, such as the sidewall, that is capable of supporting the vibratory screen sufficiently above a stationary base to permit repair or replacement work to be performed on the suspension system of the vibratory screen. The support structure may be incorporated into an existing structure of a suspension system of the vibratory screen, or may be separate from the suspension system. The support structure may in addition, or alternatively, allow a lifting device to raise the vibratory screen sufficiently above the stationary base to permit repair or replacement work to be performed on the suspensions system. Thus the support structure optionally serves to support the vibratory screen relative to a stationary base when the vibratory screen is not being supported on the suspension system. In some embodiments, the various features disclosed herein may be incorporated in other vibratory classifiers such as grizzly feeders (e.g., the embodiments disclosed in U.S. Pat. No. 2,974,795, hereby incorporated by reference herein in its entirety), incline screens, etc.

Figure 7:
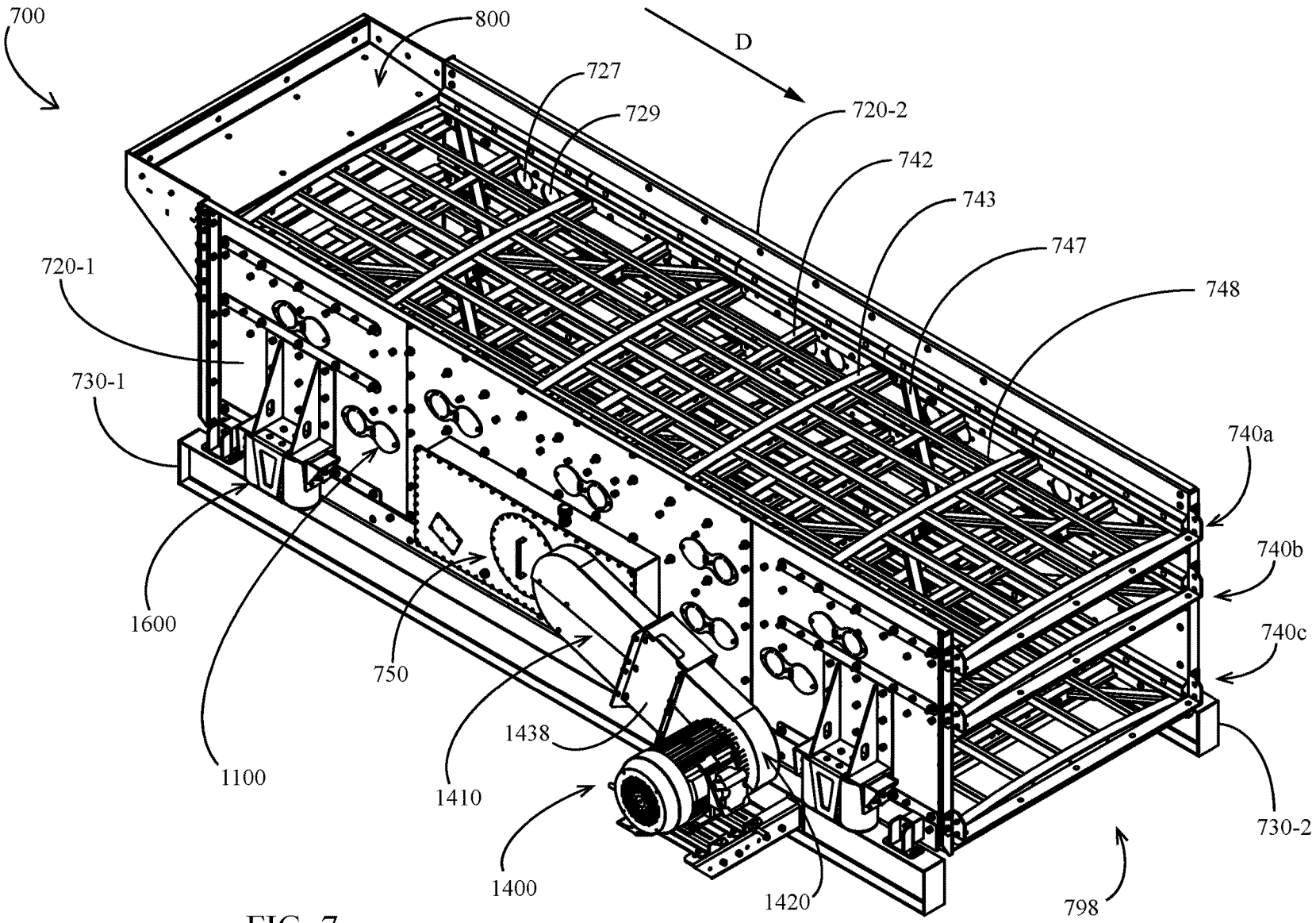
FIG. 7 is a perspective view of an embodiment of a vibratory screen.

Turning to FIG. 7, an embodiment of a vibratory screen 700 is illustrated optionally having one or more features described herein. The vibratory screen 700 may be a horizontal screen as illustrated or an inclined screen having an inlet end disposed at a different elevation (e.g., higher or lower) than an outlet end thereof. The vibratory screen 700 may be stationary or mobile and may be supported by a base structure comprising base members 730-1, 730-2 which optionally indirectly support the vibratory screen. Resilient supports (such as spring assemblies) are optionally supported by the base structure and optionally resiliently support the sidewalls 720-1, 720-2, of the vibratory screen 700 to permit vibration of the vibratory screen. The sidewalls 720-1, 720-1 are separated by a transverse distance. In the embodiment of FIG. 7, first and second resilient supports are optionally disposed at a first and second end of each sidewall such that the vibratory screen 700 is supported at four resilient support locations. Each resilient support location may be disposed adjacent to a corner of the vibratory screen as illustrated.

In some embodiments, the vibratory screen 700 optionally includes an inlet (e.g., a feed box 800) for introducing material (e.g., minerals, aggregates, rock, sand, gravel, asphalt, any of which may be wet or dry) onto one or more decks 740. Each deck optionally comprises one or more screens having openings sized to classify materials to a given specification. In the embodiment of FIG. 7, the vibratory screen 700 includes three decks 740*a*, 740*b*, 740*c* which are optionally stacked in generally vertically spaced relation.

Figure 13:
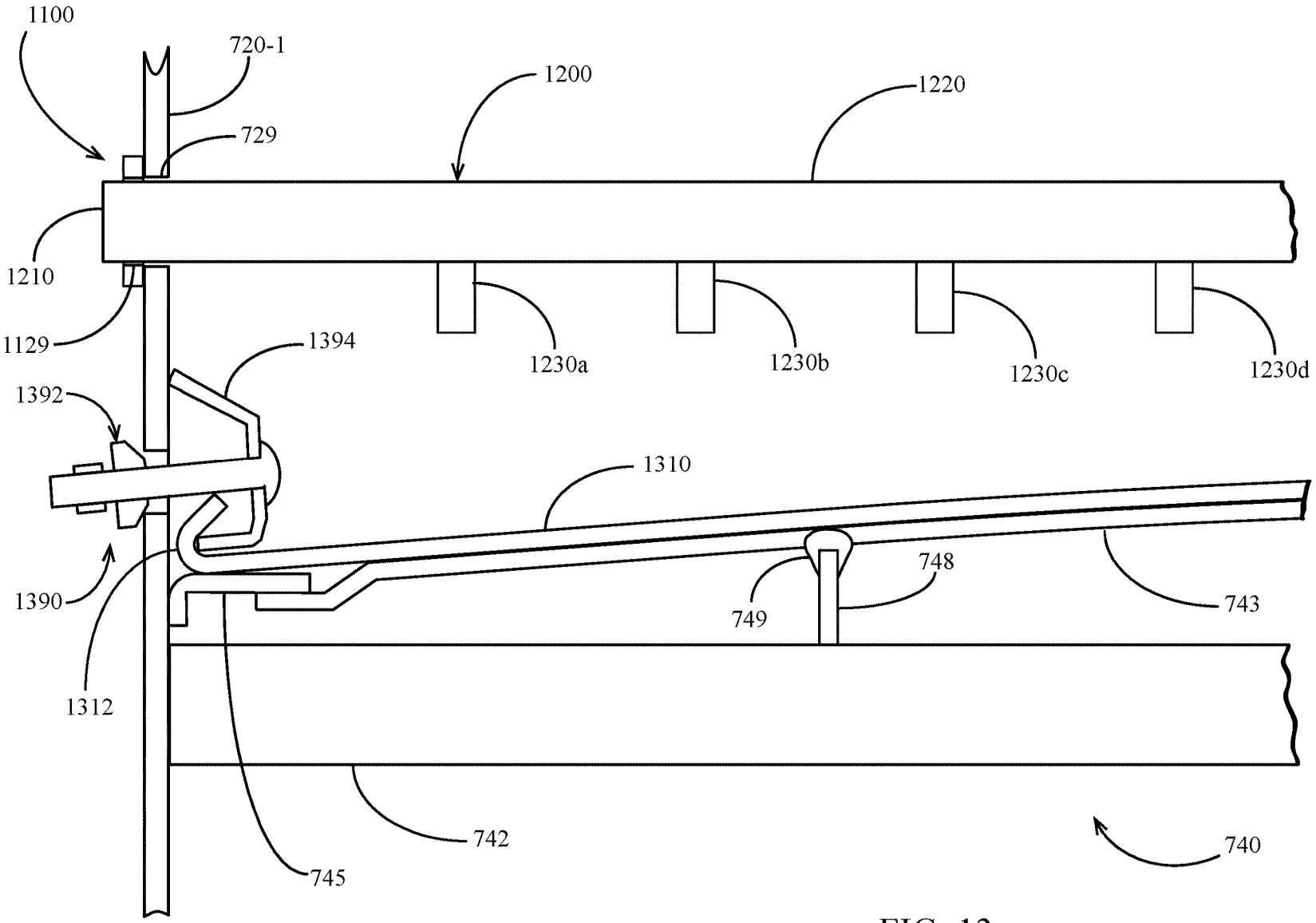
FIG. 13 is a partial sectional view of an embodiment of a vibratory screen including an embodiment of a spray bar installed via an access assembly.

Referring to FIGS. 7 and 13, in some embodiments each deck 740 is optionally mounted to the sidewalls 720 at transverse distal ends and optionally includes structural support members such as transversely extending support members 742 (which optionally extend along the transverse width of the deck), longitudinally extending support members 748 (which optionally extend along the longitudinal length of the deck along the longitudinal direction D), and diagonally extending support members 747 (which may extend at an angle relative to the longitudinal direction D toward a transverse midpoint of the deck as illustrated). The support members 748 may be mounted to and supported by the support members 742 and/or support members 748. The support members 748 may include an upper portion 749 (e.g., a rubber grommet or metal contact rail) which optionally contacts and supports at least a portion of a screen 1310 in a position suspended over the deck. Support straps 743 optionally extend transversely across the deck 740 and are optionally curved upward to support at least a portion of the screen 1310 in an optionally upwardly curved configuration suspended over the deck. The support straps 743 may be mounted to the sidewalls 720, for example by being affixed (e.g., welded, bolted) to a longitudinally extending flange 745. The flanges 745 may be mounted to each opposing sidewall 720 (or to transverse distal ends of the deck 740) and optionally extend along the longitudinal length of the sidewalls 720.

In some embodiments, the screen 1310 optionally extends at least partially across the length and width of the deck 740 (and optionally substantially across the length and width of the deck) for classifying materials on the deck. The screen 1310 may comprise any classifying medium such as a cloth screen or wire mesh screen. It should be appreciated that the screen 1310 may comprise a plurality of separate screen media arranged end-to-end, optionally along the forward direction D. In some such embodiments, the support straps 743 are optionally disposed at a longitudinal spacing such that the support straps are disposed beneath the adjacent ends of the separate screen media.

Figure 17:
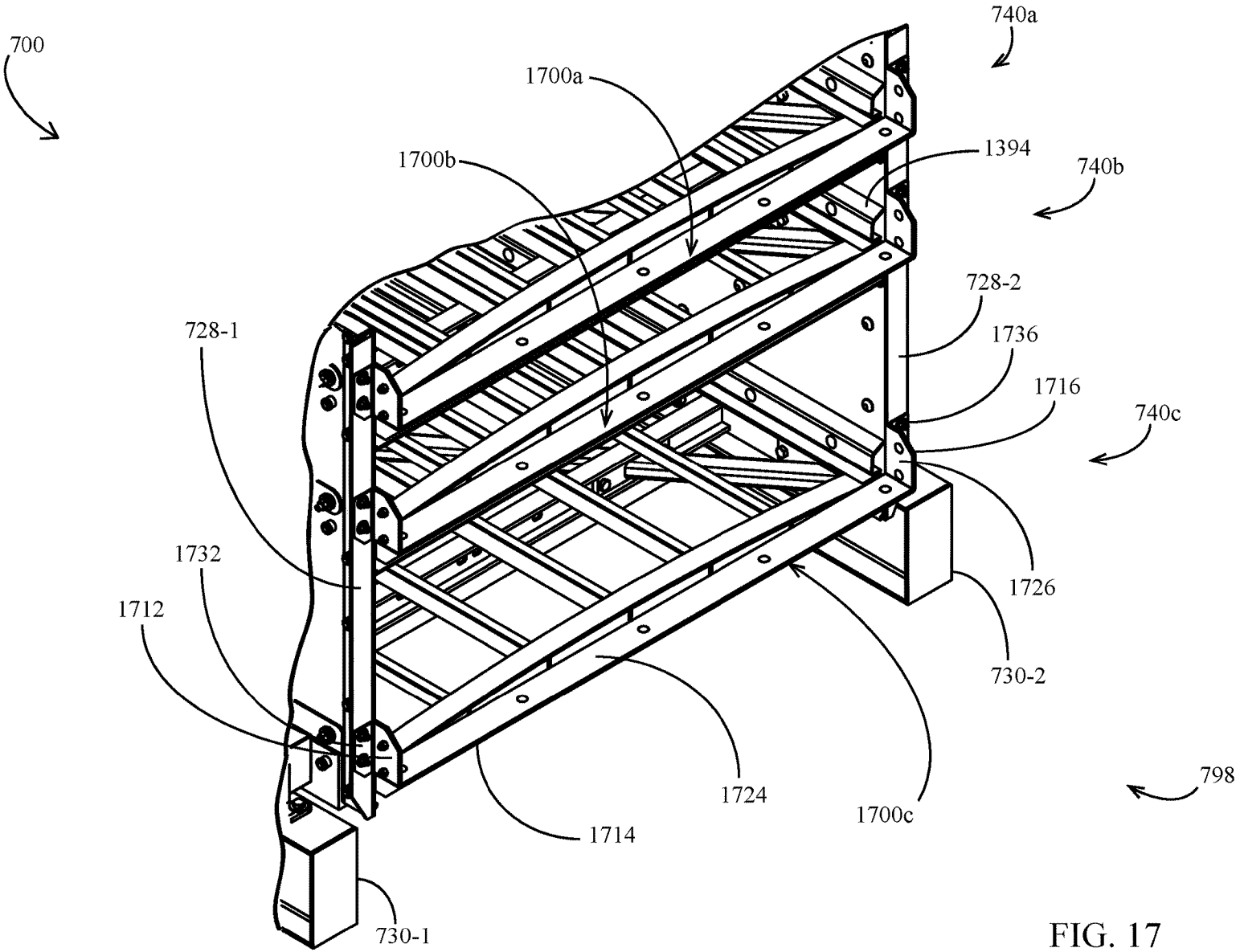
FIG. 17 is a perspective view of an embodiment of discharge lip assemblies of a vibratory screen.

In some embodiments, the screen 1310 may be mounted to the vibratory screen 700 by attachment to both sidewalls 720 (or in alternative embodiments, to transversely distal ends of the deck 740). In the illustrated embodiment, the screen 1310 optionally includes one or more transversely extending hooks 1312 and the screen 1310 is tensioned across the deck 740 (e.g., in contact with the support members 748 and/or the support straps 743) by fixing the hooks 1312 to an adjustable tensioning assembly 1390. The tensioning assembly 1390 optionally includes a longitudinally extending tensioning rail 1394 (e.g., take-up rail) which is also illustrated in FIG. 17. The hooks 1312 (or other feature of the screen 1310) are optionally removably attached to the tensioning rail 1394, for example by attaching the hooks to a lower lip of the tensioning rail. The hooks 1312 may be supported from beneath by the flange 745. The tensioning assembly 1390 may be adjusted to place the screen 1310 in tension by adjusting the position of a nut-and-bolt combination 1392 in order to advance the tensioning rail 1394 toward the sidewall 720.

In some embodiments, the decks described herein may comprise screens having differing classification criteria such as screen size (e.g., the largest dimension of openings in the screen); for example, the upper deck 740*a* may have a larger screen size than the middle deck 740*b* and the middle deck 740*b* may have a larger screen size than the lower deck 740*c*.

In some embodiments, the vibratory screen 700 optionally includes a drive system 1400 configured to drive an eccentric weight assembly 750. The eccentric weight assembly optionally includes one or more eccentric weights (e.g., eccentrically weighted shafts or gears having eccentric weights mounted thereto) such as is disclosed in U.S. Pat. Nos. 4,340,469 and/or 6,347,708, the disclosures of which are hereby incorporated by reference in their entirety herein. The configuration and/or relative orientation of the eccentric weights optionally causes the vibratory screen 700 to move (e.g., vibrate) about a selected path (e.g., circular or elliptical) when the eccentric weight assembly is driven by the drive system 1400. The eccentric weight or weights optionally rotate about a horizontal axis generally transverse to the forward direction D (FIG. 7).

In operation of some embodiments, materials to be classified are optionally introduced through the feed box 800 onto one or more decks 740. The vibratory movement (e.g., circular movement, elliptical movement) of the vibratory screen 700 optionally causes some materials to pass through the decks 740; for example, at least some of the materials (e.g., fines) having a size smaller than a screen size of a deck 740 optionally fall through the deck. Materials passing through decks 740*a*, 740*b* optionally fall onto the deck or decks below; materials passing through lower deck 740*c* may fall onto a conveyor (not shown) or collection bin or hopper (not shown) disposed beneath the vibratory screen 700 for transfer away from the vibratory screen to another processing step or storage location. The vibratory movement of the vibratory screen 700 also optionally advances some of the materials (e.g., by repeated impact against one of decks 740) along a generally forward direction (such as the direction D shown in FIG. 7) toward an outlet end 798 of the vibratory screen. Materials that advance past the outlet end 798 on one or more of the decks 740 are optionally passed out of the vibratory screen 700, optionally via a chute (not shown) which may be mounted to one or more of the decks (e.g., fitted to discharge lips of the decks as described further herein) for receiving materials discharged from the outlet end 798.

Feed Box Embodiments

Figure 8:
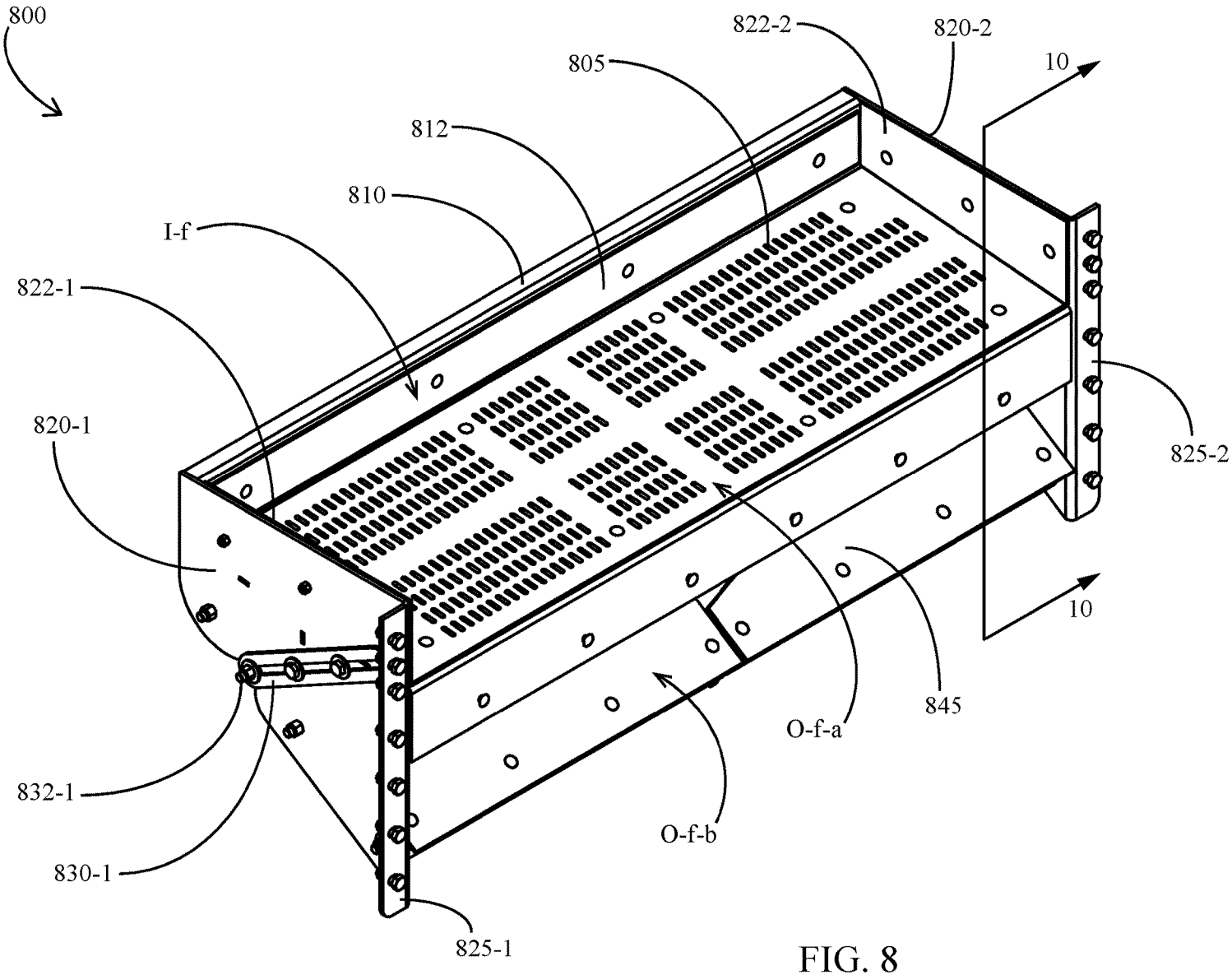
FIG. 8 is a perspective view of an embodiment of a feed box of a vibratory screen.
Figure 10:
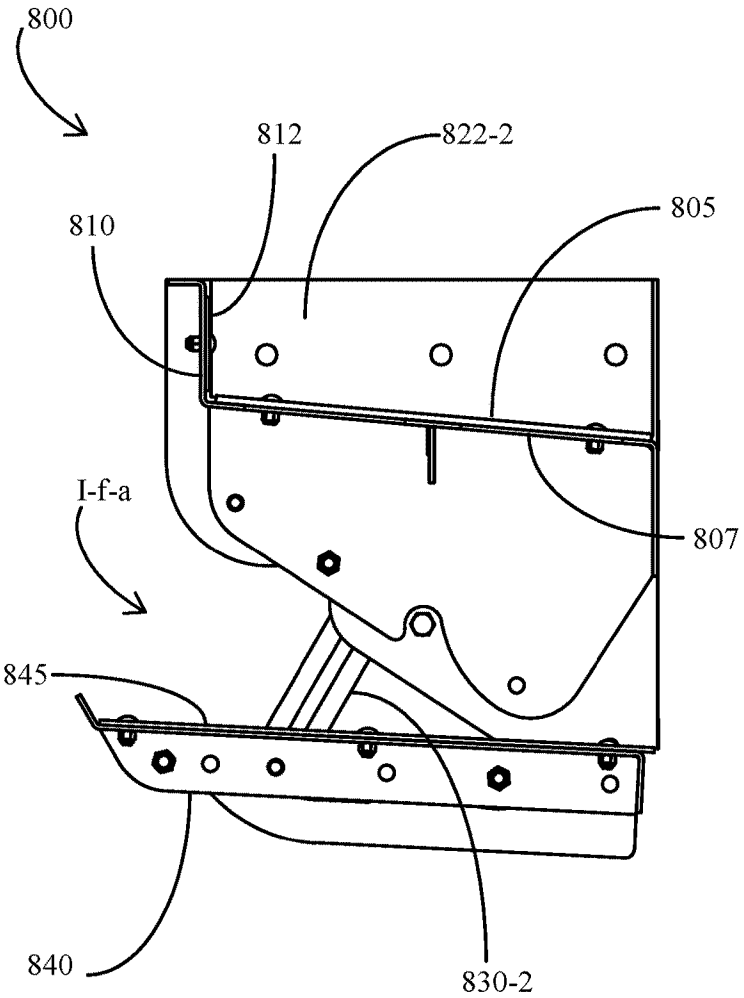
FIG. 10 is a sectional side view of the feed box of FIG. 8.
Figure 9:
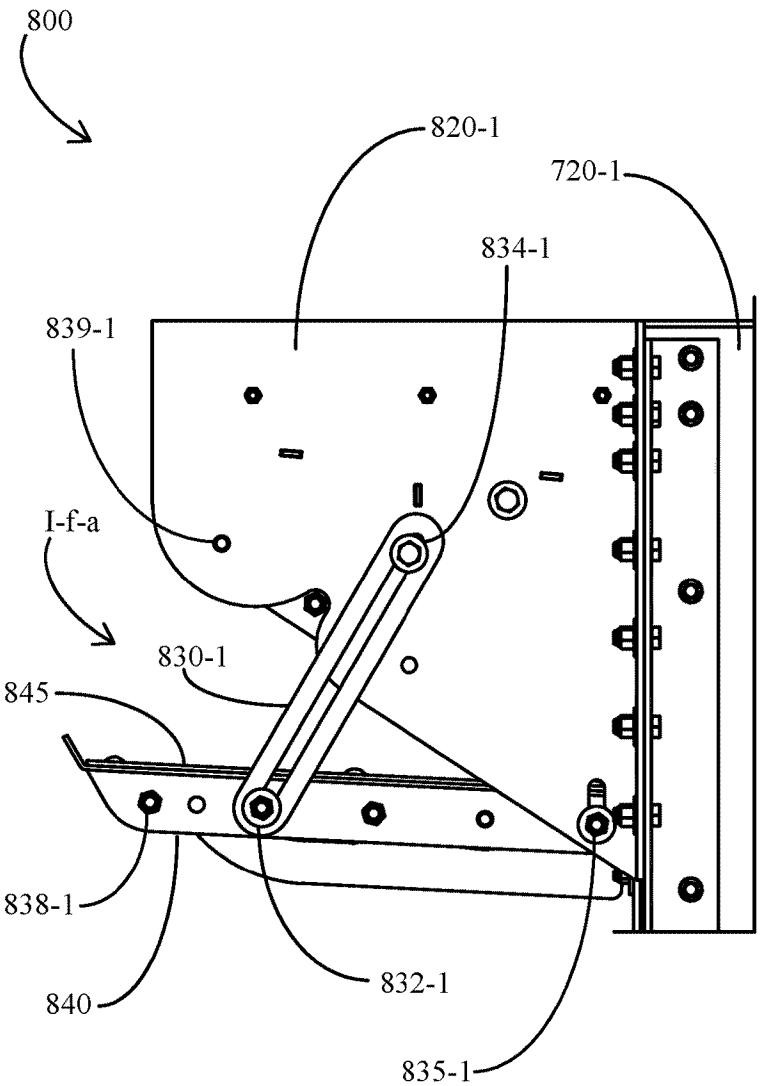
FIG. 9 is a side elevation view of the feed box of FIG. 8.

Turning to FIGS. 8 through 10, an embodiment of a feed box 800 is illustrated. The feed box 800 optionally includes a pair of sidewalls 820-1, 820-2 which are optionally mounted (e.g., by removable fasteners such as nut-and-bolt assemblies as illustrated, by fasteners such as rivets, or by welding) to the sidewalls 720-1, 720-2, respectively, of the vibratory screen 700. Each sidewall 820 may include a lip 825 (e.g., a transversely-extending lip which may be formed by bending a portion of the sidewall) which is mounted (e.g., bolted) to a respective sidewall 720 of the vibratory screen 700. The sidewalls 820 and a rearward wall 810 optionally cooperate to form an inlet region I-f through which materials are introduced (e.g., from a conveyor or chute) onto a surface 805. The surface 805 may be bolted to and supported from beneath by one or more longitudinally-extending support members 807 of the feed box. The surface 805 is optionally inclined such that materials are urged (e.g., by gravity and/or by vibrational motion of the vibratory screen 700) to move toward an upper outlet region O-f-a. It should be appreciated that because the feed box 800 is optionally rigidly mounted to the sidewalls 720, the feed box 800 optionally vibrates with the remainder of the vibratory screen, thus urging materials forward along the surface 805 toward the upper outlet region O-f-a. The upper outlet region O-f-a is optionally adjacent to a lower rearward inlet region of the upper deck 740*a* such that materials passing forward from the feed box 800 through the upper outlet region O-f-a are transferred onto the upper deck 740*a*.

The surface 805 is optionally perforated to allow smaller-sized components of the materials to fall through the perforations onto a lower surface 845. The lower surface is optionally inclined to urge materials toward a lower outlet region O-f-b. The lower outlet region O-f-b is optionally adjacent to a rearward inlet region of the middle deck 740*b* such that materials passing forward through the upper outlet region O-f-a are transferred onto the middle deck 740*b*. The surfaces 805 and 845 optionally comprise a metal such as steel and in some embodiments may comprise a wear resistant material such as abrasion-resistant steel. Wear surfaces 822 may be mounted to sidewalls 820. A wear surface 812 may be mounted to the rearward wall 810. The wear surfaces 822, 812 may comprise a wear resistant material such as abrasion-resistant steel, and are optionally removably mounted (e.g., by bolting) to the sidewalls 820 and rearward wall 810, respectively.

In operation, as materials are introduced through the inlet region I-f as the feed box 800 optionally vibrates with the remainder of the vibratory screen 700. Materials optionally repeatedly impact the perforated surface 805 and optionally advance generally forwardly across the perforated surface 805, propelled by gravity and/or by vibration (e.g., elliptical or circular movement) of the surface 805. A first portion of the materials having a first, higher range of sizes optionally advances forward out of the upper outlet region O-f-a onto the upper deck 740*a*. A second portion of the materials having a second, lower range of sizes (e.g., fines) optionally falls through the perforations in the perforated surface 805 and onto the lower surface 845. The second portion of materials optionally advance to the lower outlet region O-f-b (propelled by gravity and/or vibration) and onto the middle deck 740*b*.

In a maintenance mode, the feed box 800 optionally enables an operator to selectively open the feed box in order to access the vibratory screen 700. The feed box 800 optionally enables an operator to access the vibratory screen from the inlet end thereof (e.g., in order to access a deck such as the middle deck 740*b*). In some embodiments, an access portion (e.g., panel) of the feed box may selectively at least partially unfastened from the remainder of the feed box. The access portion is optionally displaceable (e.g., by rotating about a hinge, by sliding, or by removing) in order to create an access inlet. In the embodiment of FIGS. 8 through 10, the lower surface 845 may be selectively pivoted to a lowered position in order to create an access inlet I-f-a. The access inlet I-f-a optionally permits access to the middle deck 740*b* and optionally extends substantially the length of the middle deck such that a screen 1310 on the middle deck may be removed through the access inlet. The lower surface 845 is optionally mounted (e.g., bolted) to a panel 840. The panel 840 is optionally pivotally connected to the sidewalls 820 by bolts 835. The bolts 835 optionally have a common central axis about which the panel 840 pivots. The bolts 835 may be loosened in a maintenance mode to displace the panel 840 and may be tightened prior to operation of the vibratory screen 700. Bolts 838 optionally additionally secure the panel 840 to openings 839 in the sidewalls 820 during operation; the bolts 838 are optionally removable in the maintenance mode. Links 830 (e.g., slotted links as illustrated) on each side of the panel 840 optionally retain the panel 840 (and thus the lower surface 845) in the lowered position. As the panel 840 pivots to the lowered position, a bolt 832 optionally slidingly connects the link 830 to the panel 840. A bolt 834 optionally operably connects the link 830 to the sidewall 820. The bolts 832, 834 may be selectively loosened to allow movement of the panel 840 and the link 830 in the maintenance mode. It should be appreciated that the length of the link 830 (e.g., the length of a slot formed therein) defines the maximum length between the bolts 832, 834 and thus the maximum range of pivotal motion of the panel 840. The length of the link 830 is optionally selected such that the lower surface 845 is oriented generally horizontally (e.g., as illustrated) in the lowered position.

In other embodiments of the feed box 800, the surface 805 may alternatively or additionally be selectively displaceable (e.g., pivotable, slidable) in order to permit access to the interior of the vibratory screen. In other embodiments, the entire feed box may be selectively displaced (e.g., pivoted, slid) away from the remainder of the vibratory screen to permit access to the interior of the vibratory screen.

Access Assemblies

Referring to FIGS. 7 and 11 through 13, a plurality of access assemblies 1100 are illustrated disposed along the length of both sidewalls 720. Although described herein according to some embodiments as assemblies, according to various embodiments the access assembly may comprise a unitary part or component having a plurality of features (e.g., a plate of sheet metal having one or more slots, removable panels, removable covers, or removable portions, etc.).

Each access assembly 1100 optionally provides selective access to an opening 727 (e.g., a circular opening as illustrated) formed in sidewall 720. The access assembly 1100 optionally includes a panel 1102. According to various embodiments, the panel 1102 may be disposed generally adjacent to the sidewall 720 as illustrated or in other embodiments may be disposed at a transverse spacing from the sidewall. According to various embodiments, the panel 1102 may be generally flat and/or disposed generally parallel to the sidewall 720; in alternative embodiments the panel 1102 may have other shapes or orientations. The access assembly 1100 (e.g., the panel 1102 thereof) optionally includes a mounted portion 1116 which is optionally mounted (e.g., removably mounted such as by bolting through openings 1132, 1134 as illustrated, or permanently mounted such as by welding) to the sidewall 720. The mounted portion 1116 is optionally disposed adjacent to (e.g., generally about the perimeter of) the opening 727. The access assemblies 1100 optionally include an access gate 1150. The access gate 1150 optionally has a first position in which it covers (or substantially covers) the opening 727 in sidewall 720. The access gate 1150 is optionally selectively displaceable (e.g., opened, pivoted, slid or removed) to a second position to allow access to the opening 727. In the illustrated embodiment, the access gate 1150 is pivotally coupled to the mounted portion 1116 by a hinge 1152. In various alternative embodiments, the hinge 1152 is instead mounted directly to the sidewall 720 or to a separate panel mounted to sidewall 720.

Referring to FIG. 13, each access assembly 1100 is optionally located above the screen of a deck 740 (e.g., middle deck 740*b* and/or lower deck 740*c*). The access assembly (and the associated opening 727, see FIG. 11) is optionally located at a height above the screen (e.g., between 3 inches and 2 feet) which is low enough to permit an operator to reach through the opening 727 and manipulate the screen 1310 (e.g., to attach or detach the hook 1312 of the screen 1310 to or from the rail 1394). The opening 727 is optionally sized to receive the hand and/or arm of an operator (e.g., the opening may have a diameter of at least 6 inches). The gate 1150 may be secured in the first position (e.g., a closed position as shown in FIG. 12) by a fastener such as a bolt, which may extend through an opening 1136 through the gate 1150, the mounted portion 1116, and/or at least a portion of sidewall 720.

Figure 12:
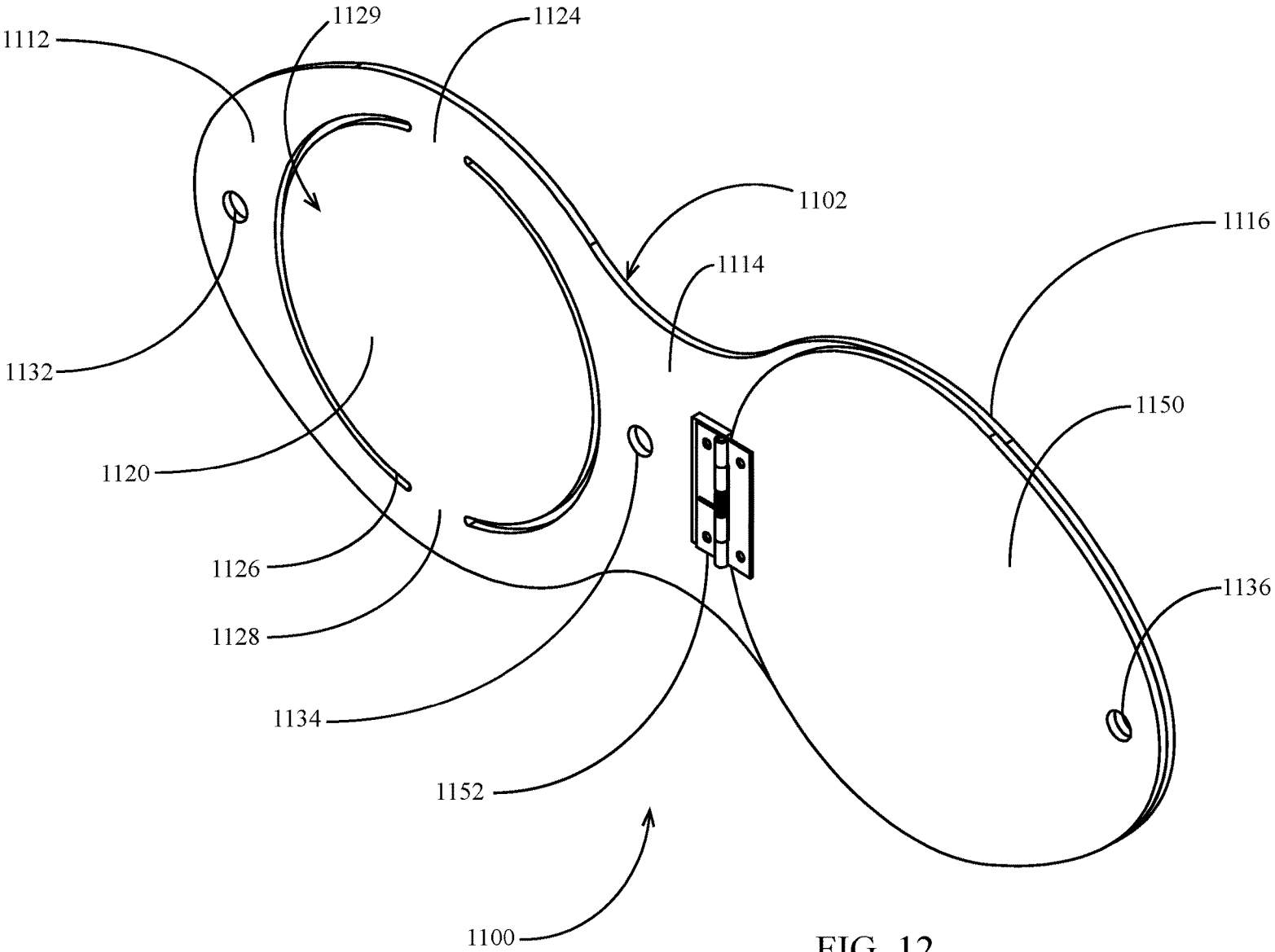
FIG. 12 is a perspective view of the access assembly of FIG. 11.

Referring to FIG. 12, each access assembly 1100 also optionally includes a removable cover 1120 which removably covers (e.g., is optionally at least partially transversely aligned with) an opening 729 in the associated sidewall 720. When the cover 1120 is removed to reveal an opening 1129 (e.g., an opening previously at least partially obstructed by the cover 1120), a spray bar 1200 may be installed through the opening 729. Referring to FIG. 13, in such embodiments among others, openings 729 are optionally disposed in opposing sidewalls 720-1, 720-2 along a common transverse axis (e.g., are at least partially transversely aligned) such that a spray bar 1200 may be installed through both opposing openings 729. The spray bar 1200 may be of any configuration for applying a liquid to the classifier (e.g., to the deck 740 below the access assembly 1100). In some embodiments, an inlet end 1210 of the spray bar may be in fluid communication with a fluid source (e.g., water pump) such that fluid fills a transversely extending manifold 1220 of the spray bar. The spray bar optionally includes a plurality of outlets 1230 (e.g., openings, nozzles, etc.) disposed to direct a fluid (e.g., in a spray, stream, or droplet form) in a direction (e.g., generally toward the screen 1310). The outlets 1230 (e.g., 1230*a*, 1230*b*, 1230*c*, 1230*d*, etc.) are optionally disposed at a plurality of positions along the length of the manifold 1220 and in fluid communication with the manifold 1220.

Figure 31:
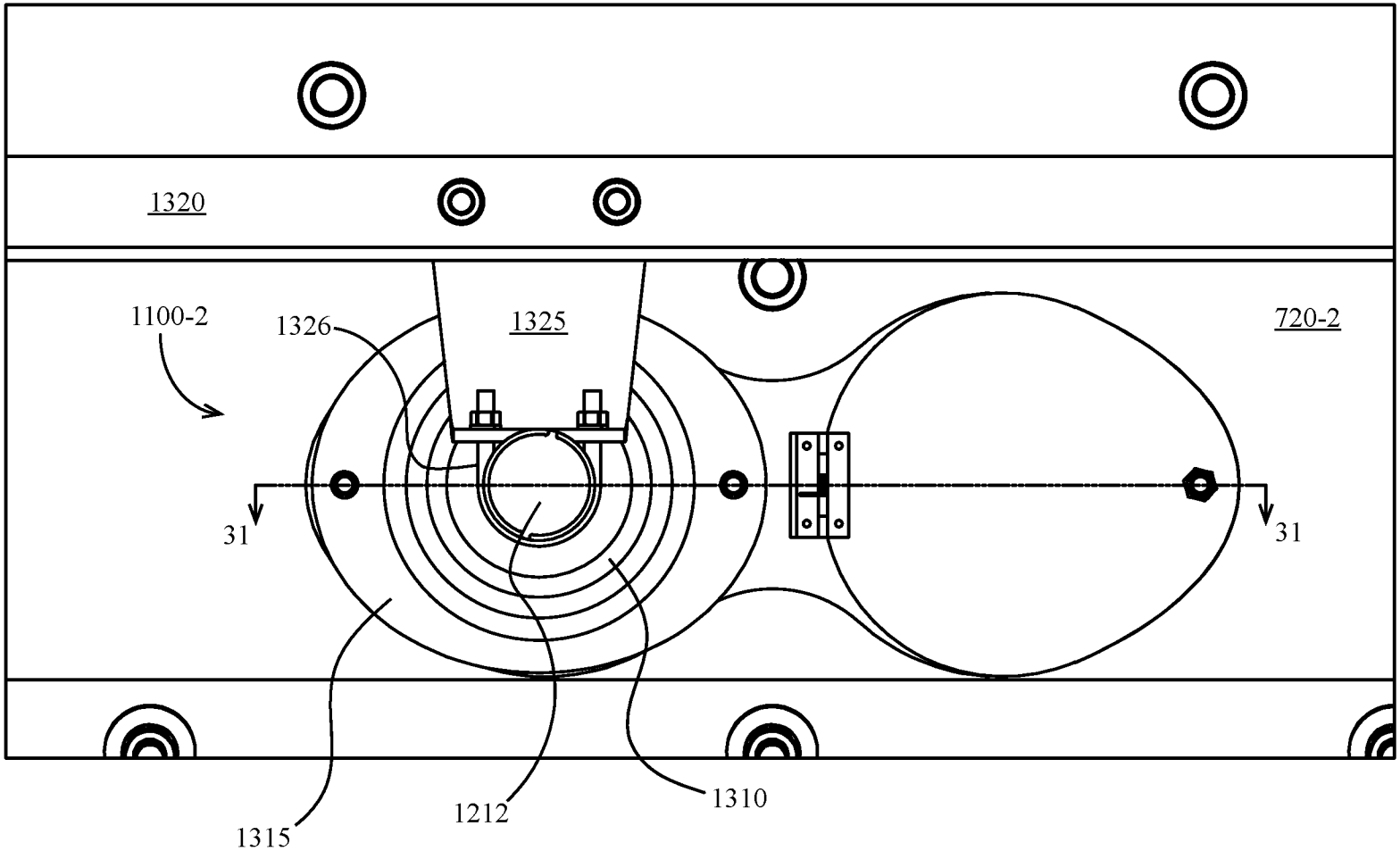
FIG. 31 is a partial side elevation view of an embodiment of a vibratory screen with a spray bar installed.
Figure 32:
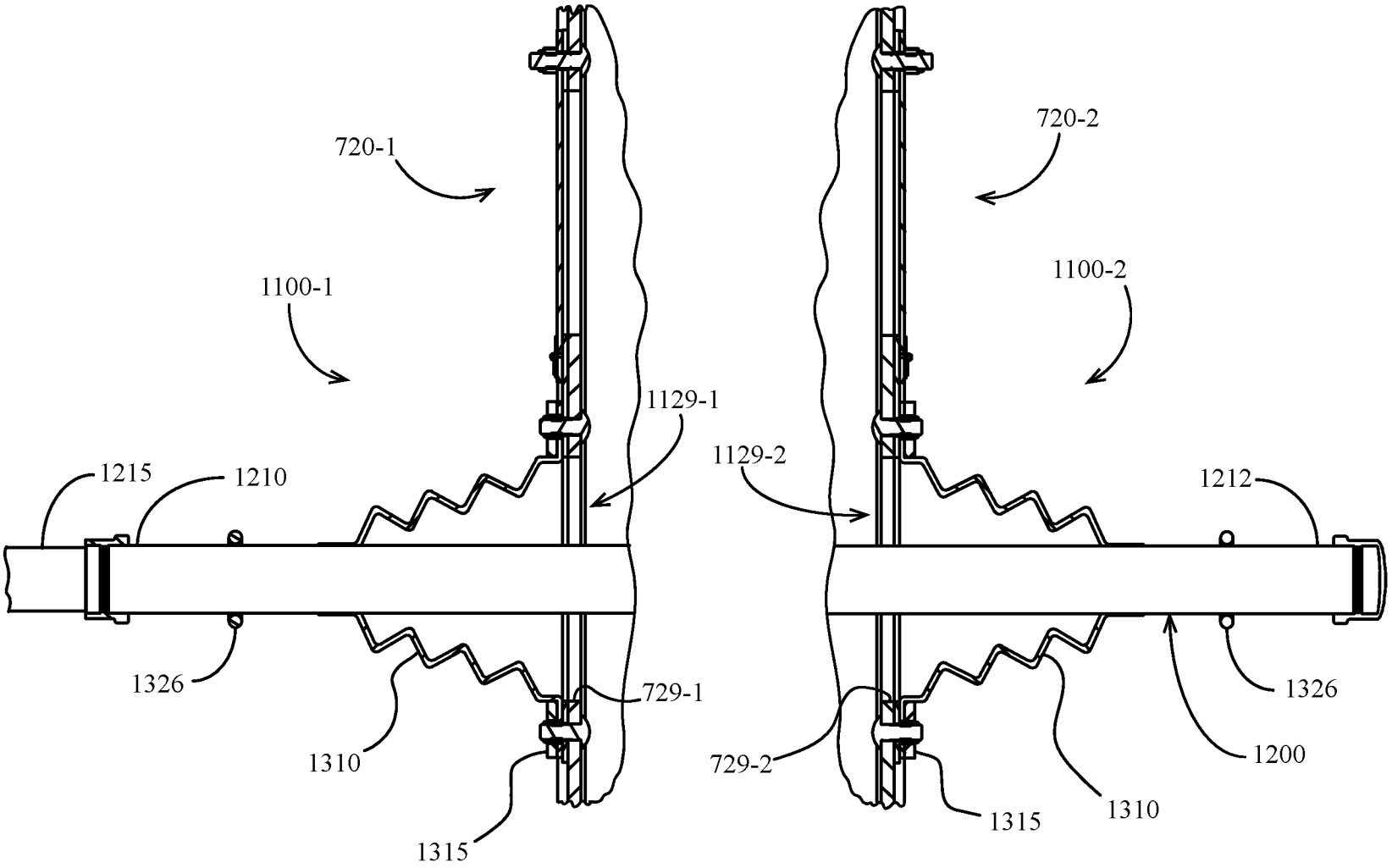
FIG. 32 is a cross-sectional view along the section 31-31 of FIG. 31.

Referring to FIGS. 31 and 32, an embodiment of a vibratory screen is shown having the covers 1120 of two access assemblies 1100-1, 1100-2 removed and a spray bar 1200 installed through the uncovered openings 1129 in the access assemblies and openings 729. In some embodiments, the openings 729 and openings 1129 on both sidewalls are at least partially transversely aligned (e.g., intersected by a common transverse axis) such that a spray bar 1200 may be inserted therethrough in a transverse orientation. In some embodiments, a seal 1310 (e.g., a flexible seal made of rubber, plastic or any flexible material) is fitted (e.g., press-fit) around each end of the spray bar 1200. The seal 1310 is optionally secured to the access assembly 1100 with a collar 1315. The seal 1310 optionally extends radially between the perimeter of opening 1129 and the spray bar, e.g., to substantially seal material from escaping the classifier via the opening 1129. The collar 1315 is optionally removably mounted to the access assembly 1100, e.g., using one or more of the fasteners (e.g., nut and bolt assemblies) that optionally attach the access assembly 1100 to the sidewall 720. In some embodiments, the spray bar 1200 is at least partially supported separately from the vibratory screen (e.g., by bracket 1325 and/or U-bolt 1326 connecting the spray bar 1200 to a rail 1320) such that the spray bar is at least partially isolated from vibration of the vibratory screen; in other embodiments, the weight of the spray bar is supported by the seal and/or the access assembly such that the spray bar vibrates with the vibratory screen. In some embodiments, the inlet end 1210 of the spray bar 1200 is in fluid communication with a supply of water (e.g., by a conduit 1215 which may be a flexible or rigid conduit). An opposing end 1212 of the spray bar 1200 is optionally closed.

In the illustrated embodiment, the removable cover 1120 is held in place by connection tabs 1124, 1128 which may be formed as a part with the cover 1120 and a mounted portion 1112 which surrounds the opening 1129 when the cover 1120 is removed. During spray bar installation, the connection tabs 1124, 1128 may be removed (e.g., by torching or cutting the connection tabs, or by applying pressure to the cover 1120) in order to remove the cover 1120. In other embodiments, the cover 1120 may be a sliding or pivoting gate similar to the gate 1150. One or more slots 1126 (e.g., arcuate slots) optionally extend between connection tabs 1124, 1128 and are optionally disposed at a perimeter of the cover 1120. The connection tabs 1124, 1124 optionally have a thickness less than a thickness of the sidewall 720. The removable cover 1120 optionally has a thickness less than the thickness of the sidewall 720.

Figure 11:
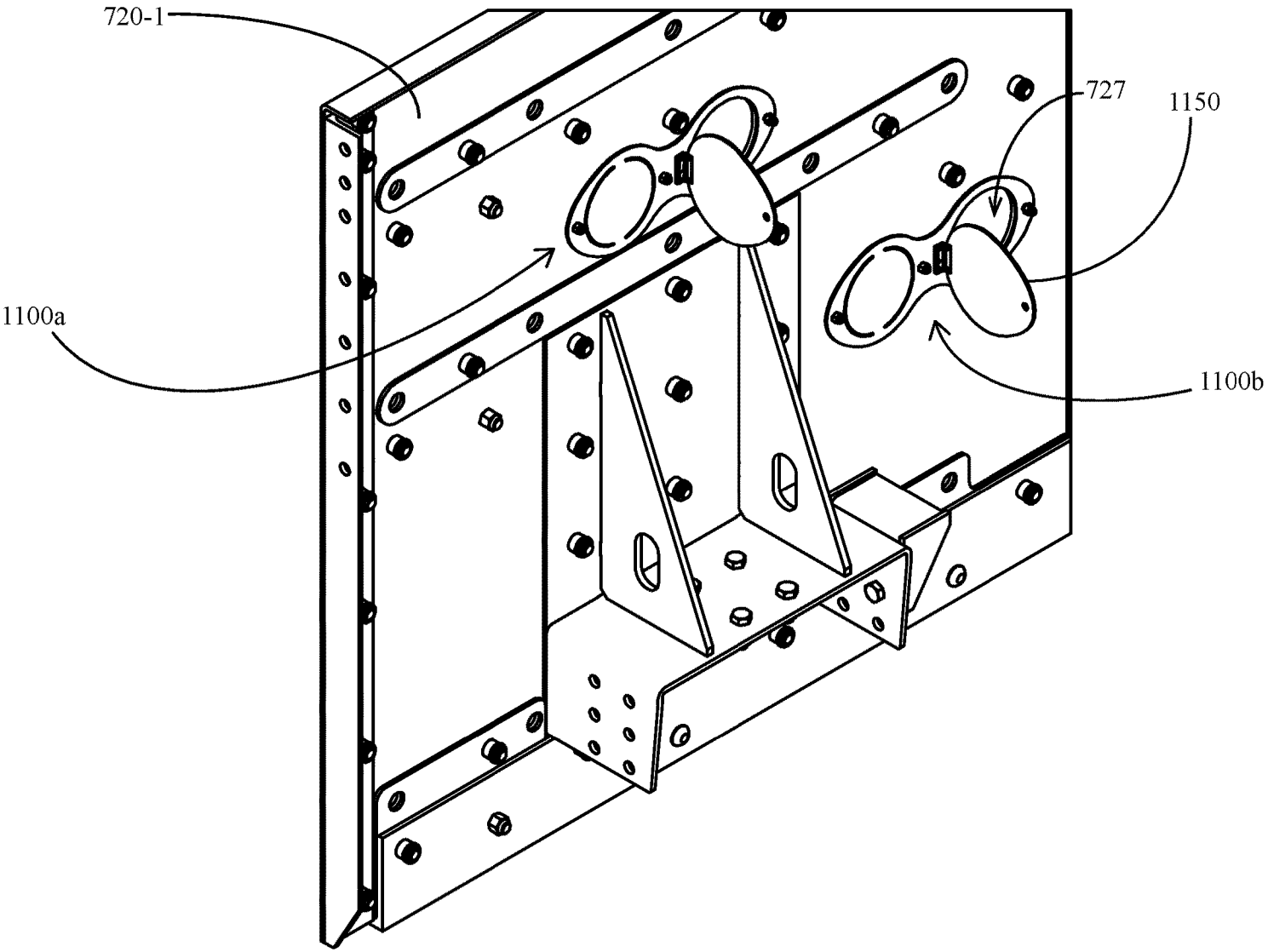
FIG. 11 is a perspective view of an embodiment of an access assembly on a vibratory screen.

It should be appreciated that although the access assembly 1100 is illustrated having the cover 1120 and access gate 1150 joined by a central portion 1114, the cover and gate may be part of separate assemblies and may be spaced apart from one another. In such embodiments, the openings 727, 729 are still optionally positioned to be covered by the access gate and cover, respectively. It should also be appreciated that assemblies similar to the access assembly 1100 could be mounted additionally or alternatively to other areas of the vibratory screen (e.g., to a rearward, forward, upper or bottom wall of the screen) in order to allow selective access to various portions of the vibratory screen. As illustrated in FIG. 11, a plurality of access assemblies 1100 (e.g., assemblies 1100*a* and 1100*b*) are optionally disposed at a plurality of heights along the sidewalls 720 in order to allow access to a plurality of decks (e.g., the middle deck 720*b* and the lower deck 720*c*).

Referring to FIGS. 22-26, an embodiment of an access assembly 2200 is illustrated. The access assembly 2200 optionally has common features with the access assembly 1100 as illustrated. The access assembly 2200 optionally includes a panel 2202 mounted (e.g., removably mounted) to the sidewall 720. The panel 2200 optionally includes mounted portion 1112 and mounted portion 1116.

The access assembly 2200 optionally has a modified access gate 2250 optionally having an opening 2258 therethrough. A lock 2264 (e.g., a tab, plate, bar or other structure) is optionally sized and/or shaped to pass through the opening 2258 in a first configuration (e.g., the position shown in FIG. 23). In the first configuration, the lock 2264 optionally allows the access gate 2250 to be displaced (e.g., pivoted) away from the sidewall 720. In a second configuration (e.g., the configuration illustrated in FIG. 25), the lock 2264 optionally does not pass through the opening 2258. In the second configuration, the lock 2264 optionally restrains the access gate 225 adjacent to the sidewall 720 (e.g., against and/or flush with and/or parallel to with the mounted portion 1116). A fastener or fastener assembly such as a nut 2262 and/or bolt 2260 optionally selectively restrain the lock 2264 in the second configuration such that the access gate 2250 does not displace away from the panel 2202 and/or the sidewall 720 during operation (e.g., vibration) of the classifier. The fastener assembly (e.g., nut 2262 and/or bolt 2260) also optionally secures the mounted portion 1116 to the sidewall 720; in other embodiments, the fastener assembly secures the lock 2264 without securing the mounted portion against the sidewall.

In some embodiments, a fastener assembly (e.g., nut 2222 and bolt 2220) optionally removably secures the mounted portion 1112 to the sidewall 720. In some embodiments, a fastener assembly (e.g., nut 2242 and bolt 2240) optionally removably secures the central portion 1114 to the sidewall 720.

The lock 2264 is optionally pivotally mounted to the bolt 2260. For example, an opening (e.g., round opening) in lock 2264 optionally receives the bolt therethrough. The lock 2264 optionally pivots (e.g., in a plane parallel to the sidewall 720) between the first and second configuration. The nut 2262 optionally selectively secures the lock 2264 from rotation when tightened against the lock. In other embodiments, the lock is coupled to the panel 2202 and/or the sidewall 720 such that an alternative motion (e.g., sliding motion, translational motion, pivotal motion normal to the sidewall 720, pivotal motion in a plane not parallel to the sidewall 720, etc.) of the lock or other structure displaces the lock between the first and second configuration. In still other embodiments, an adjustment (e.g., sliding adjustment or other motion) of the access gate 2250 selectively locks the access gate to the lock 2264 (or other structure) additionally or alternatively to displacement of the lock 2264.

According to various embodiments, the access gate 2250 and/or opening 2258 and/or lock 2264 may have other shapes and/or configurations permitting selective locking of the access gate 2250. For example, in some embodiments the lock 2264 may comprise a sliding bar selectively lockable in one of two positions and mounted to the sidewall 720 and/or to the panel 2202. In the first position of the sliding bar, the lock 2264 optionally locks the access gate 2250 against the panel 2202. In the second position of the sliding bar, the lock 2264 optionally permits the access gate 2250 to be pivoted between open and closed positions. In such an embodiment the opening 2258 is optionally omitted. In still other embodiments, the access gate may be displaced by a sliding rather than pivoting motion, and/or may be selectively fully removed from the access assembly.

In alternative embodiments, the removable cover 1120 is hingedly, slidingly or otherwise displaceably coupled to the panel 2202 and/or to the sidewall 720. For example, in some embodiments the removable cover 1120 is optionally generally similar to the access gate 2250 and may be hingedly connected to the panel 2202 and/or selectively locked in place by a lock having a first configuration allowing free movement of the removable cover and a second configuration retaining the removable cover.

Figure 24:
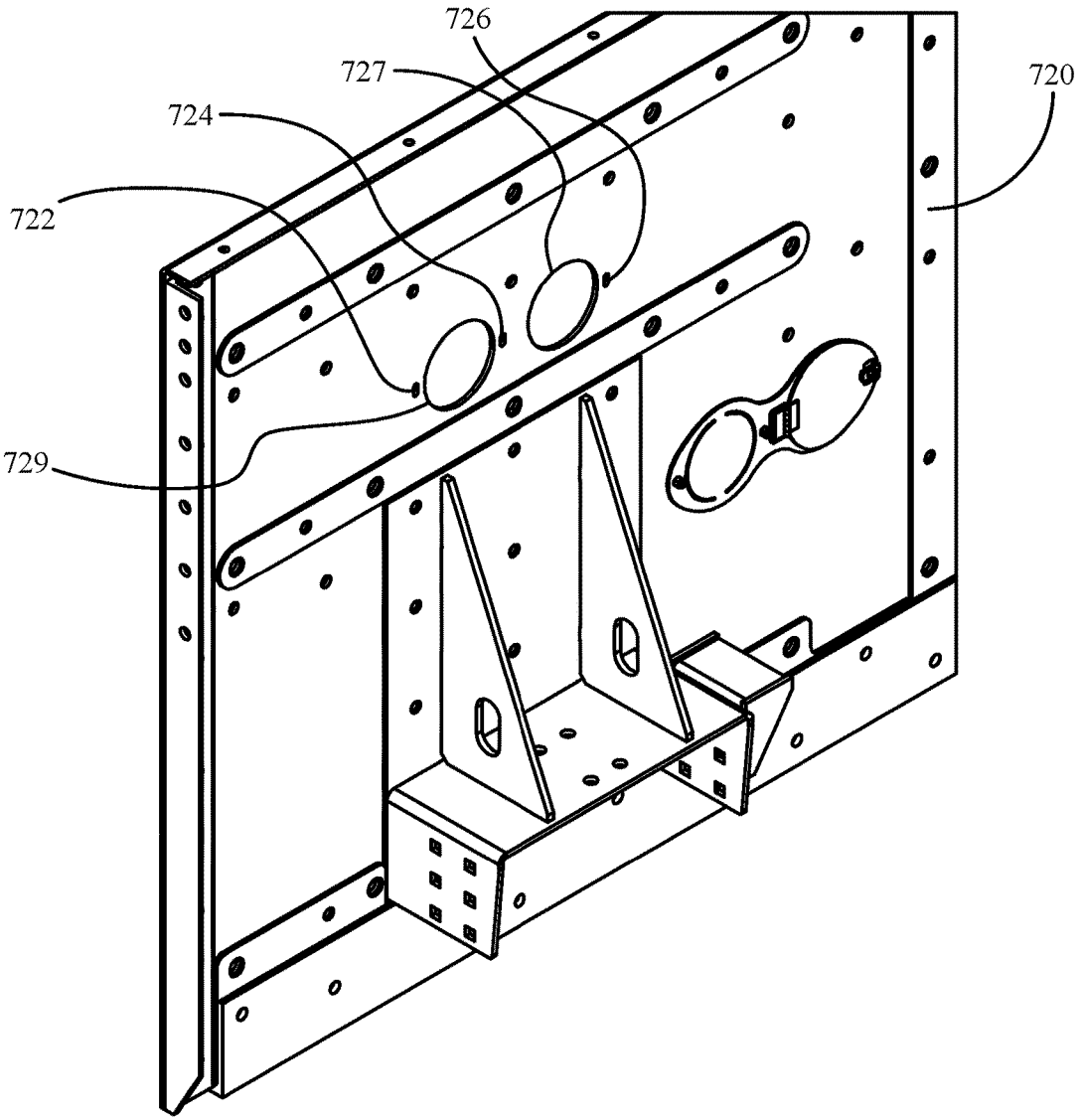
FIG. 24 is a partial perspective view of the vibratory screen of FIG. 22 with an access assembly thereof not shown.
Figure 25:
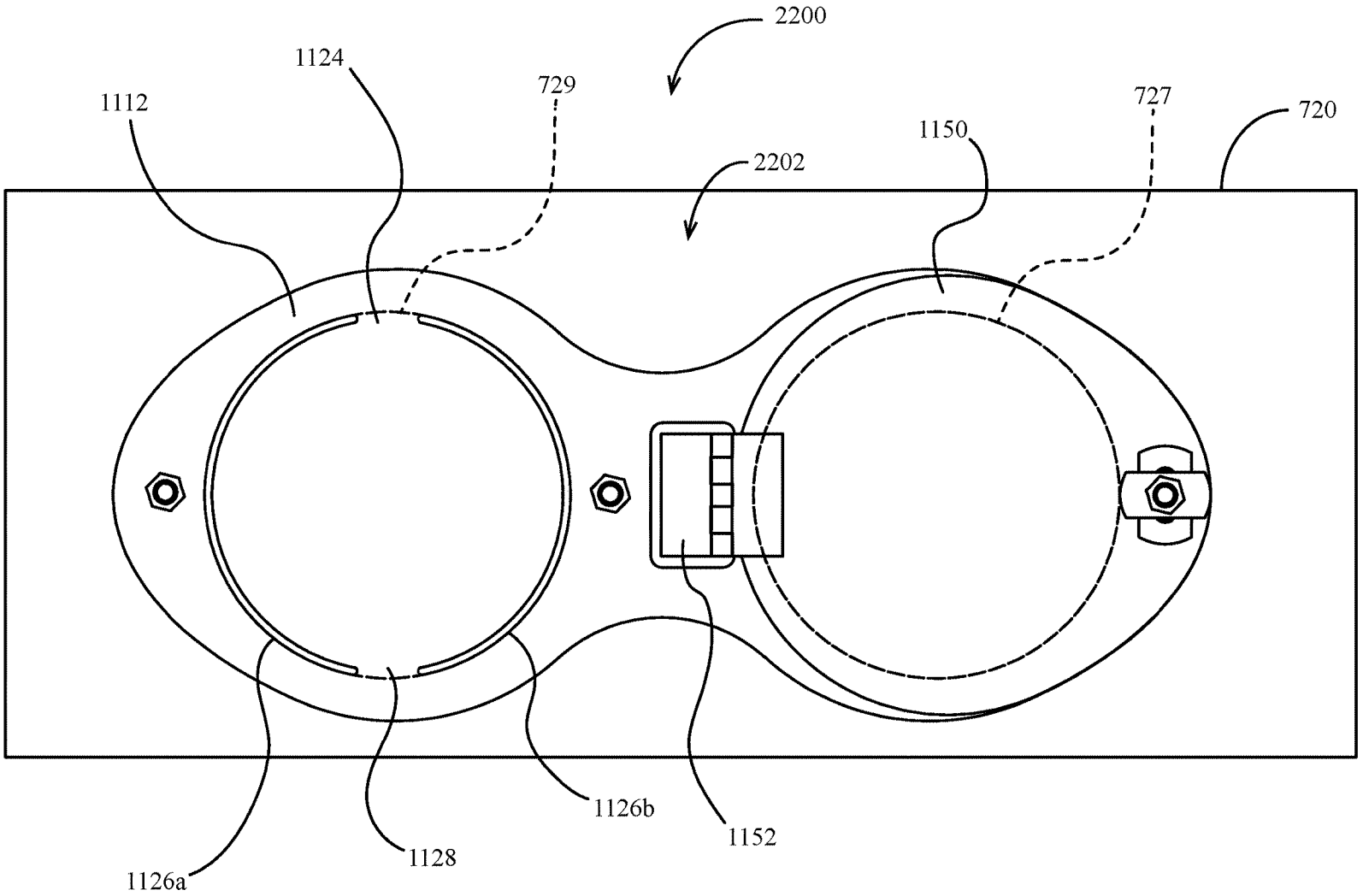
FIG. 25 is a partial side elevation view of the vibratory screen of FIG. 22.

Referring to FIG. 24, the sidewall 720 is illustrated with one of the access assemblies removed. Opening 729 in the sidewall 720 (e.g., a pre-made opening cut or formed in the sidewall 720) is optionally at least partially aligned with the removable cover 1120 (e.g., as viewed from a side elevation view) such that displacement and/or removal of the removable cover at least partially exposes the opening 729. Opening 727 in the sidewall 720 (e.g., a pre-made opening cut or formed in the sidewall 720) is optionally at least partially aligned with the access gate 2250 (e.g., as viewed from a side elevation view) such that displacement and/or removal of the access gate at least partially exposes the opening 727.

Referring to FIG. 24, in some embodiments, openings 722, 724, and/or 726 receive bolts 2220, 2240, and/or 2260 therethrough. In various alternative embodiments, the panel 2202 and/or mounted portions 1112 and/or 1116 are fastened to sidewall 720 by other fasteners and/or welded or formed as a part with the sidewall.

Figure 26:
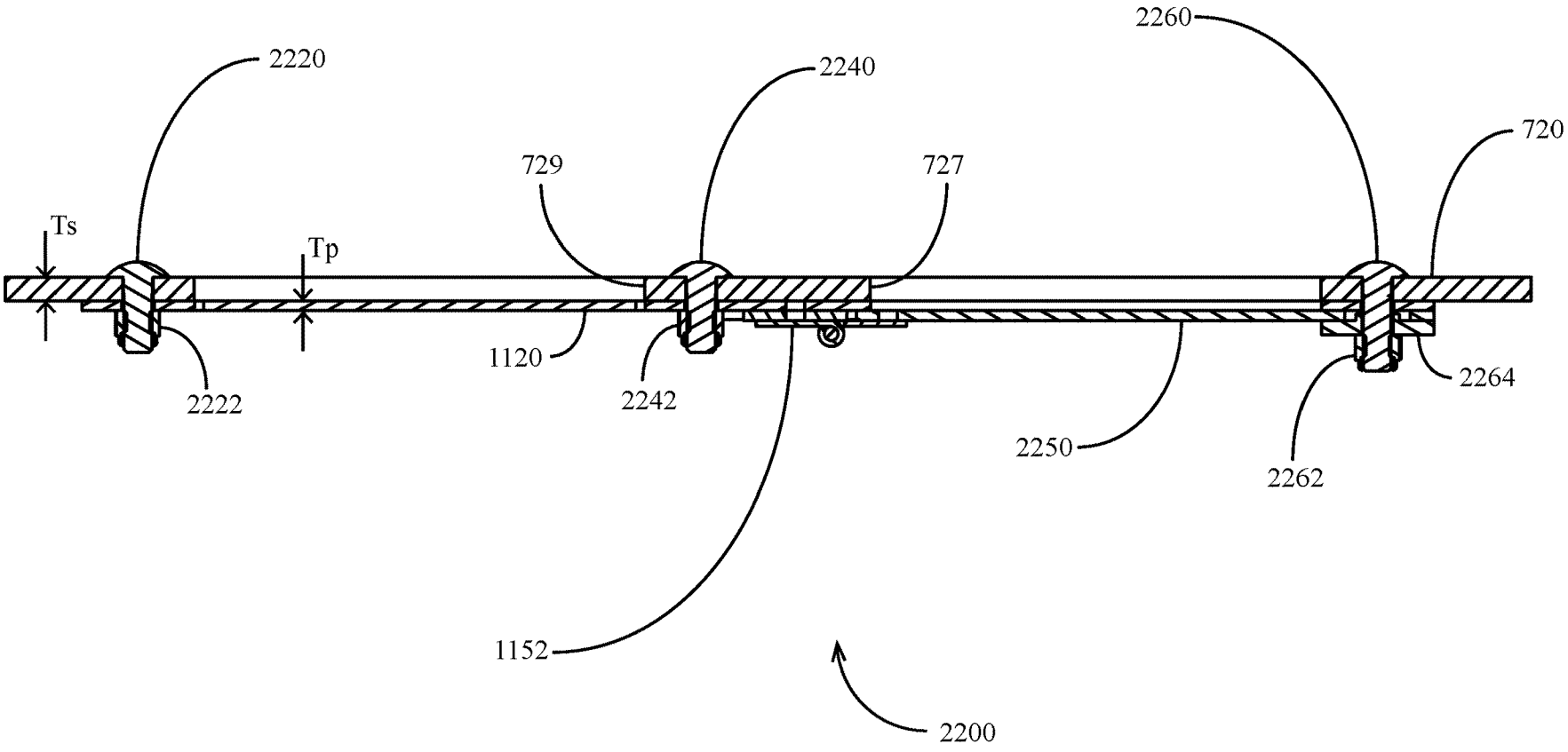
FIG. 26 is a cross-sectional view along the section 25-25 of FIG. 25.
Figure 28:
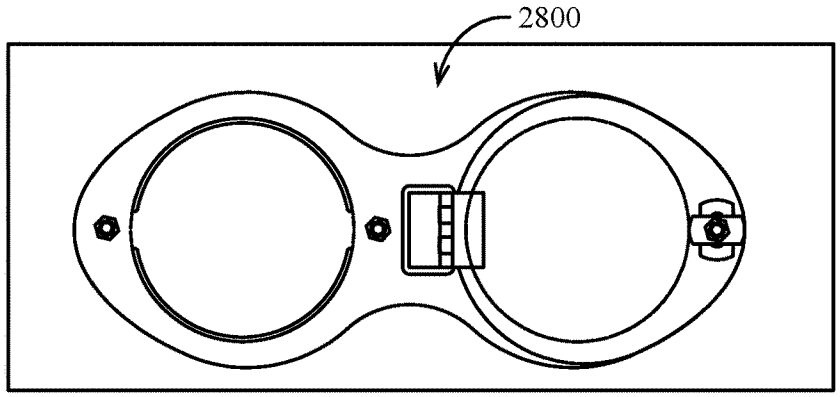
FIG. 28 is a side elevation view of another embodiment of an access assembly.
Figure 27:
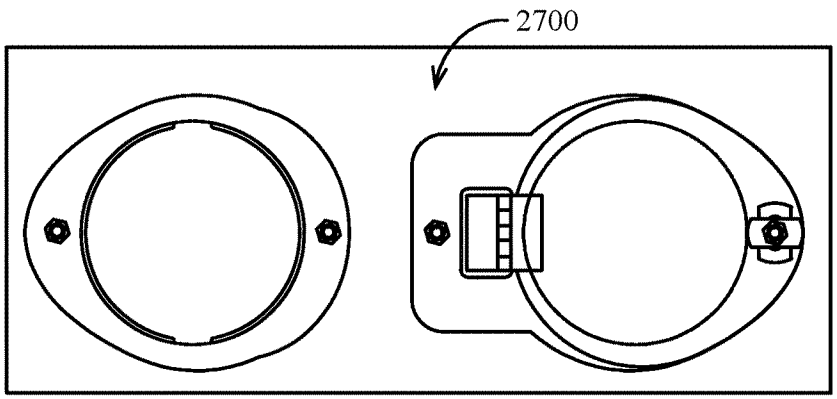
FIG. 27 is a side elevation view of another embodiment of an access assembly.
Figure 30:
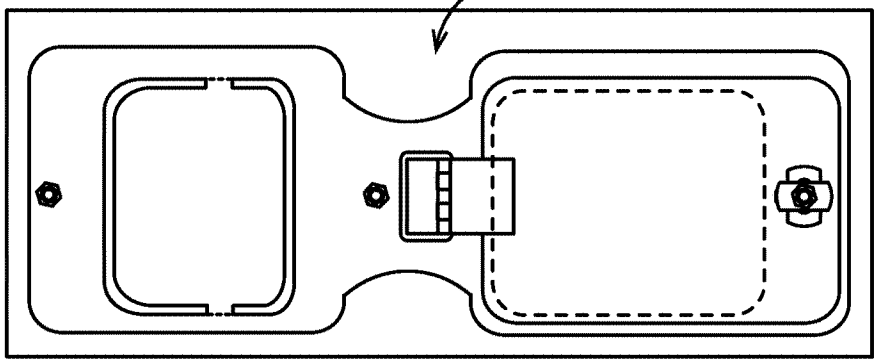
FIG. 30 is a side elevation view of another embodiment of an access assembly.
Figure 29:
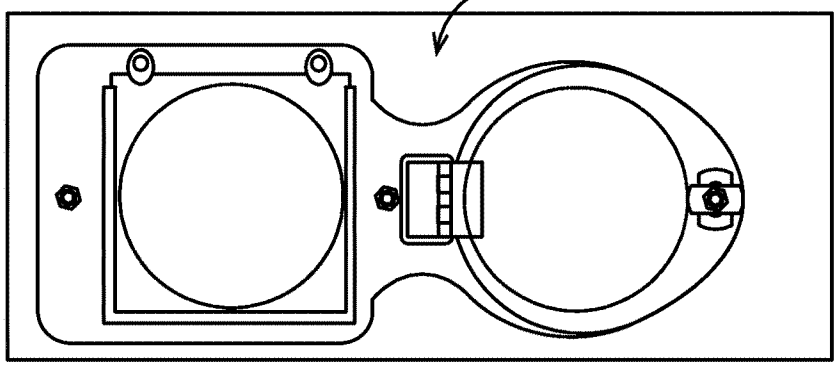
FIG. 29 is a side elevation view of another embodiment of an access assembly.

Referring to FIG. 26, a thickness Tp of the panel 2202, cover 1120, and/or the connection tabs 1124, 1128 is optionally less than (e.g., substantially less than) a thickness Ts of the sidewall 720 (e.g., the thickness of a portion of the sidewall 720 through which the opening 729 extends). In various embodiments, Ts is optionally 5/16 inch, between ¼ inch and ½ inch, etc. In various embodiments, Tp is optionally 0.12 inches, 0.125 inches, 0.13 inches, 0.135 inches, 0.14 inches, between 0.10 and 0.15 inches, between 0.05 and 0.2 inches, etc. In some embodiments, a ratio Tp/Ts is optionally 0.4, approximately 0.4, 0.43, approximately 0.43, between 0.33 and 0.5, between 0.25 and 0.5, etc.

Referring to FIGS. 27-30, various further alternative access assembly embodiments are illustrated. In the access assembly 2700 of FIG. 27, the removable panel and access gate are optionally incorporated in separate panels which are optionally separately mounted to the sidewall 720. In the access assembly 2800 of FIG. 28, the connection tabs are oriented at different locations than in the other embodiments illustrated; for example, the connection tabs may be disposed at the forward and/or rearward ends of the removable cover. In the access assembly 2900 of FIG. 29, the removable cover is removably inserted in a sleeve disposed at least partially about the opening behind the removable cover; one or more selectively displaceable retaining tabs are optionally disposed to selectively retain the removable cover in the sleeve during operation. In the access assembly 3000 of FIG. 30, the removable cover and/or the associated opening disposed behind the removable cover are optionally non-round (e.g., generally rectangular). In the access assembly 3000 of FIG. 30, the access gate and/or the associated opening disposed behind the access gate are optionally non-round (e.g., generally rectangular).

Although some of the various access assembly embodiments described herein are described as comprising panels and/or being generally low-profile, other embodiments may comprise structure that extends substantially transversely outwardly from the side wall 720. Further, in some embodiments all or part of the access assembly may be disposed on the inside of the sidewall 720.

Drive Housing Embodiments

Figure 14:
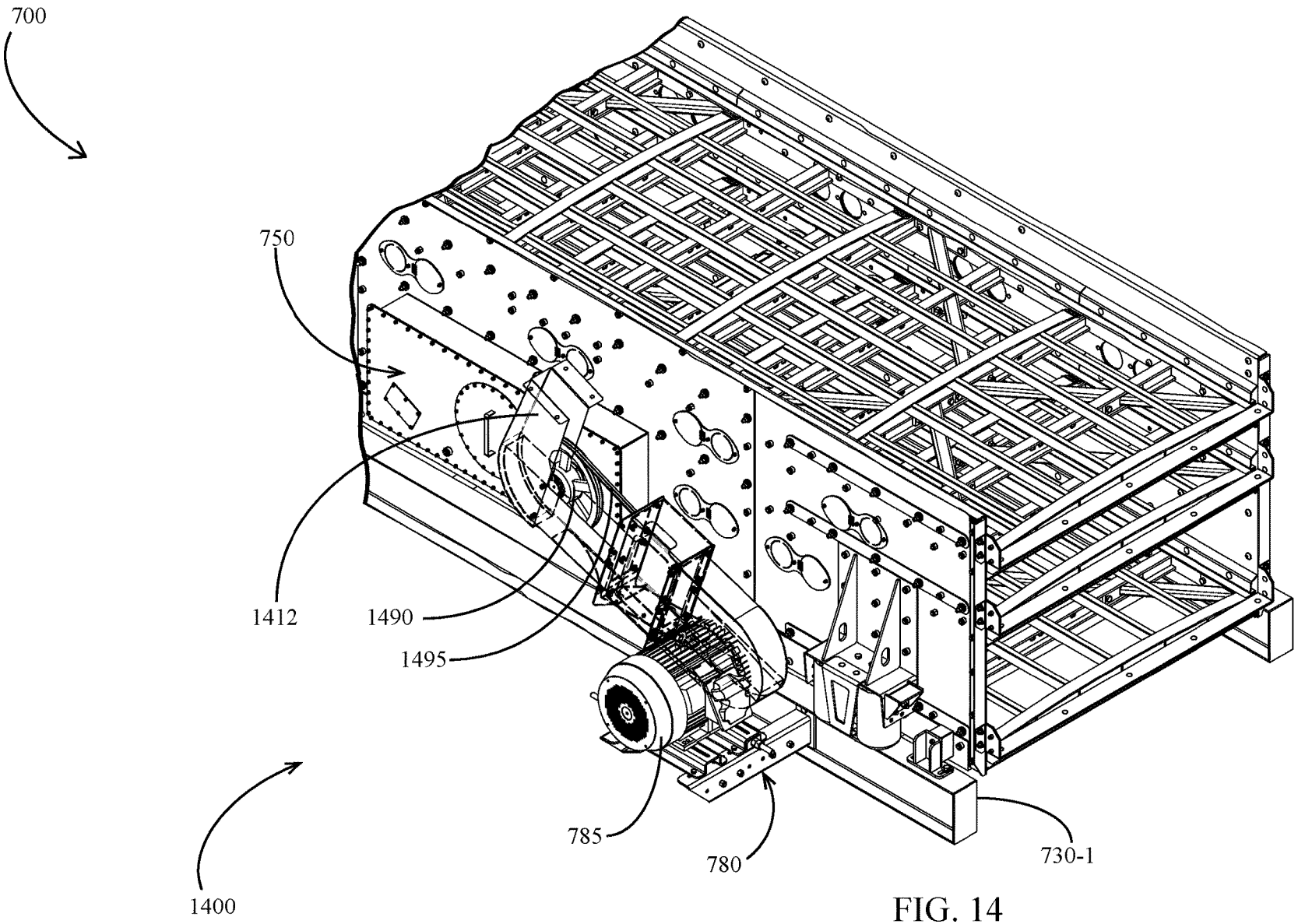
FIG. 14 is a perspective view of an embodiment of a drive system of a vibratory screen.
Figure 15:
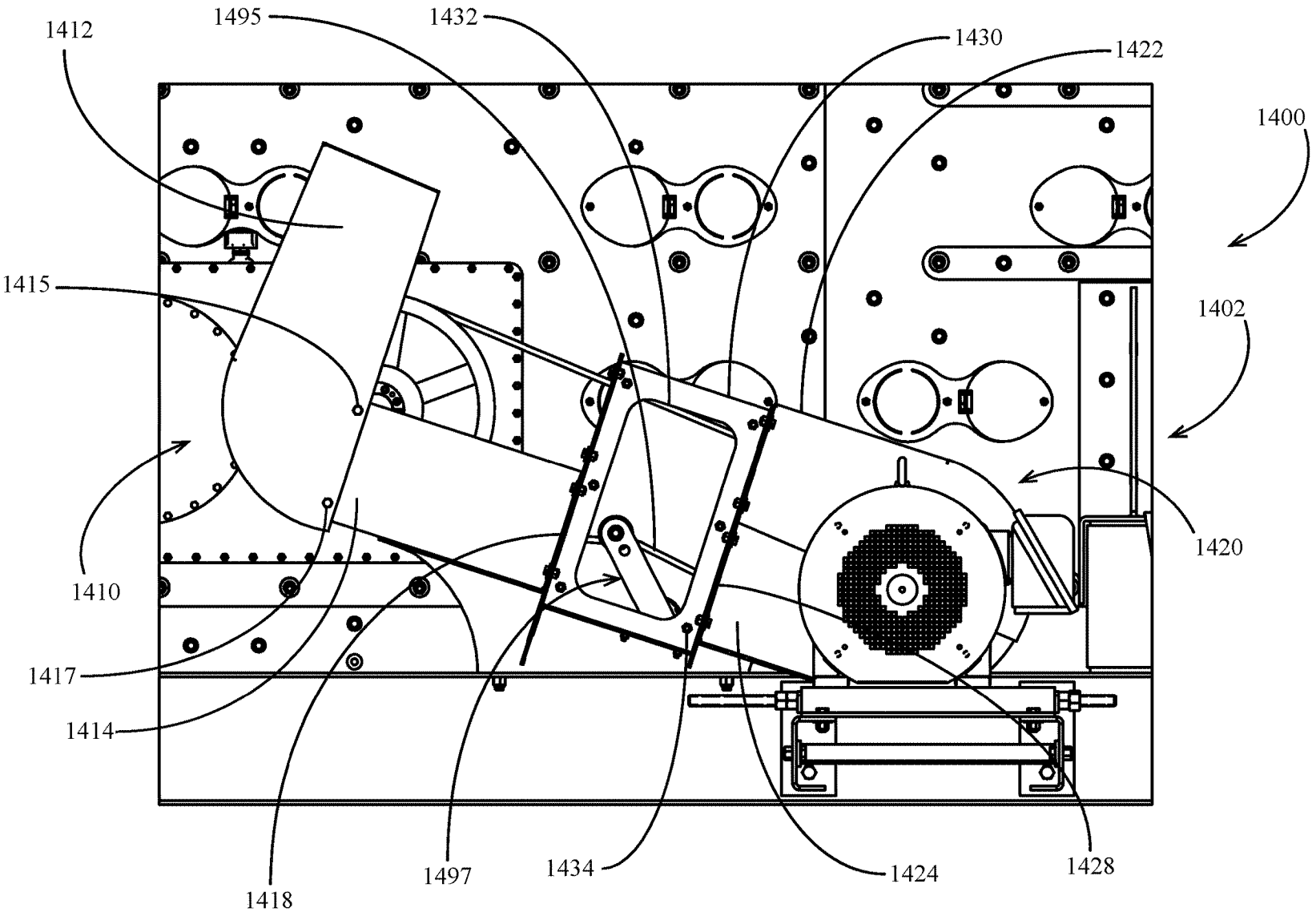
FIG. 15 is a side elevation view of the drive system of FIG. 14.

Turning to FIGS. 7, 14, and 15, a drive system 1400 is illustrated for driving the vibrational movement of the vibratory screen 700. A motor 785 is optionally supported adjacent to the vibratory screen 700; in some embodiments the motor is supported by support structure 780 (e.g., a support frame, skid and/or scaffolding) which is optionally rigidly mounted to a base member 730, while in other embodiments the motor may rest on an independent support structure or on the ground. In still other embodiments, the motor may be mounted to the vibratory screen (e.g., to a sidewall thereof) in order to vibrate with the vibratory screen. The motor 785 may be of any kind suitable for driving rotation of the vibratory screen 700 and may have a maximum speed (e.g., 1200 RPM, 1500 RPM or 1800 RPM), horsepower or torque selected to suit the size of the vibratory screen. In some embodiments, the motor 785 may comprise an electric motor such as a System Drive VFC AC Motor available from WEG Electric Corp. in Duluth, Ga.

The motor 785 optionally drives an eccentric weight (e.g., shaft and/or wheel) of the eccentric weight assembly 750 via an endless belt 1495 (or in other embodiments a chain or other power transmission apparatus) of the drive system 1400. For example, a driver pulley (not shown) may be driven by the motor 785 may drive the endless belt 1495 at a first end thereof, and a driven pulley 1490 is optionally driven by the endless belt 1495 at a second end thereof. Each of the driver pulley and driven pulley may be of any configuration such as a wheel, gear and/or shaft. A belt tensioning assembly 1497 (e.g., comprising a spring-loaded belt tensioner having a rolling cam disposed to resiliently contact the belt 1495) is optionally operably disposed to maintain tension in the belt during operation. In some embodiments, the axis of driven pulley 1490 may vibrate with the sidewall 720 in operation relative to the axis of the driver pulley driven by the motor 785, which axis may be stationary. In such embodiments, the belt tensioning assembly 1497 is optionally configured to maintain tension in the endless belt 1495 during such relative motion (e.g., vibratory motion which may be circular, elliptical, linear, etc.) of the pulley 1490 and the driver pulley.

Referring to FIG. 15, the drive system 1400 optionally comprises a housing 1402 which optionally substantially surrounds the belt 1495 during operation of the screen 700. The housing 1402 can optionally be modified in a maintenance mode in order to allow access to the belt and other components of the drive system 1400. The housing may comprise a plurality of housing sections such as a driver pulley section 1420 (e.g., a forward section as illustrated which optionally houses the driven pulley), a central section 1430, and a driven pulley section 1410 (e.g., a rearward section as illustrated which optionally houses the driven pulley).

The driven pulley section 1410 is optionally selectively openable to allow an operator to access to the belt 1495 and/or the driven pulley 1490. The section 1410 is optionally selectively lockable in an open configuration and optionally releasably mounted in a closed configuration. A closed configuration of section 1410 is shown in FIG. 7 and an open configuration of section 1410 is shown in FIGS. 14 and 15. In the closed (e.g., operational) configuration, both a lower portion 1414 and an upper portion 1412 are optionally fixed (e.g., by nut-and-bolt assemblies) to a flange 1418 (which may comprise a surface of the central section 1430) such that neither the lower or upper portion move relative to the flange as the screen 700 vibrates in operation. The lower portion and upper portion may each comprise two spaced-apart sidewalls extending on either side of the belt 1495 and a connecting wall joining the spaced-apart sidewalls. In the closed configuration, the lower portion and the upper portion optionally cooperate to substantially surround the driven pulley. The upper portion 1412 is optionally pivotally connected to the lower portion 1414. For example, the upper portion and lower portion may be pivotally joined by one or more pivots 1415 (e.g., bushings, bearings, shafts) which optionally define a generally horizontal pivotal axis. A sidewall spacing of the upper portion 1412 is optionally greater than a sidewall spacing of the lower portion 1414 to allow the upper portion to pivot freely (e.g., into the open configuration shown in FIG. 15) without interference with the lower portion; thus in the open configuration, the lower portion may be partially received within the upper portion. In a maintenance mode, the upper portion 1412 is optionally released (e.g., by removing bolts connecting the upper portion to the flange 1418) and the upper portion is optionally pivoted about the pivots 1415 into the open configuration shown in FIG. 15. In the maintenance mode, the upper portion 1412 is optionally locked into the open configuration by a removable locking apparatus 1417 (e.g., bolt or pin) which optionally extends through openings in the upper and lower portions which are optionally aligned along a common axis in the open configuration.

The driver pulley section 1420 is optionally selectively openable to allow an operator to access to the belt 1495 and/or the driver pulley 1490. The section 1420 is optionally selectively lockable in an open configuration and optionally releasably mounted in a closed configuration. A closed configuration of section 1420 is shown in FIG. 7 and an open configuration of section 1420 is not shown but is optionally similar to the open configuration of section 1410 shown in FIGS. 14 and 15. In the closed (e.g., operational) configuration, both a lower portion 1424 and an upper portion 1422 are optionally fixed (e.g., by nut-and-bolt assemblies) to a flange 1428 (which may comprise a surface of the central section 1430) such that neither the lower or upper portion move relative to the flange as the screen 700 vibrates in operation. The lower portion and upper portion may each comprise two spaced-apart sidewalls extending on either side of the belt 1495 and a connecting wall joining the spaced-apart sidewalls. In the closed configuration, the lower portion and the upper portion optionally cooperate to substantially surround the driver pulley. The upper portion 1422 is optionally pivotally connected to the lower portion 1424. For example, the upper portion and lower portion may be pivotally joined by one or more pivots (e.g., bushings, bearings, shafts) which optionally define a generally horizontal pivotal axis. A sidewall spacing of the upper portion 1422 is optionally greater than a sidewall spacing of the lower portion 1424 to allow the upper portion to pivot freely (e.g., into the open configuration) without interference with the lower portion; thus in the open configuration, the lower portion may be partially received within the upper portion. In a maintenance mode, the upper portion 1422 is optionally released (e.g., by removing bolts connecting the upper portion to the flange 1428) and the upper portion is optionally pivoted about the pivots into the open configuration. In the maintenance mode, the upper portion 1422 is optionally locked into the open configuration by a removable locking apparatus (e.g., bolt or pin) which optionally extends through openings in the upper and lower portions which are optionally aligned along a common axis in the open configuration.

The central section 1430 of the housing 1402 optionally substantially encloses a medial portion of the belt 1495 in a closed configuration (e.g., in an operational mode). The central section 1430 optionally comprises an opening 1432 which is optionally releasably enclosed by a cover 1438 in the closed configuration shown in FIG. 7. The cover 1438 may be installed and removed by the use of nut-and-bolt assemblies as illustrated, and in some embodiments the cover may be pivotally or slidingly connected to the remainder of the central section 1430. Removal of the cover 1438 optionally provides access to the medial portion of the belt 1495.

The belt tensioning assembly 1497 is optionally housed at least partially (and optionally entirely) inside the housing 1402. In the illustrated embodiment, the belt tensioning assembly 1497 is mounted to the central section 1430 (e.g., to a lower wall thereof). In other embodiments, the belt tensioning assembly may be mounted to the driven pulley section 1410 (e.g., to a lower wall thereof) or to the driver pulley section 1420 (e.g., to a lower wall thereof); in some such embodiments, a portion of the belt tensioning assembly (e.g., a rolling cam thereof) may extend into the central section 1430. In some embodiments, removal of the cover 1438 described above optionally enables the operator to manipulate, remove, repair or otherwise access the belt tensioning assembly 1437. Installation of the cover 1438 optionally substantially encloses the belt tensioning assembly 1497, e.g., sufficiently to prevent an operator or bystander from contacting the belt tensioning assembly 1497 during operation. In some embodiments, reconfiguration of the section 1410 and/or the section 1420 into an open configuration may enable the operator to manipulate, remove, repair or otherwise access the belt tensioning assembly 1437.

Spring Assembly Embodiments

Figure 16:
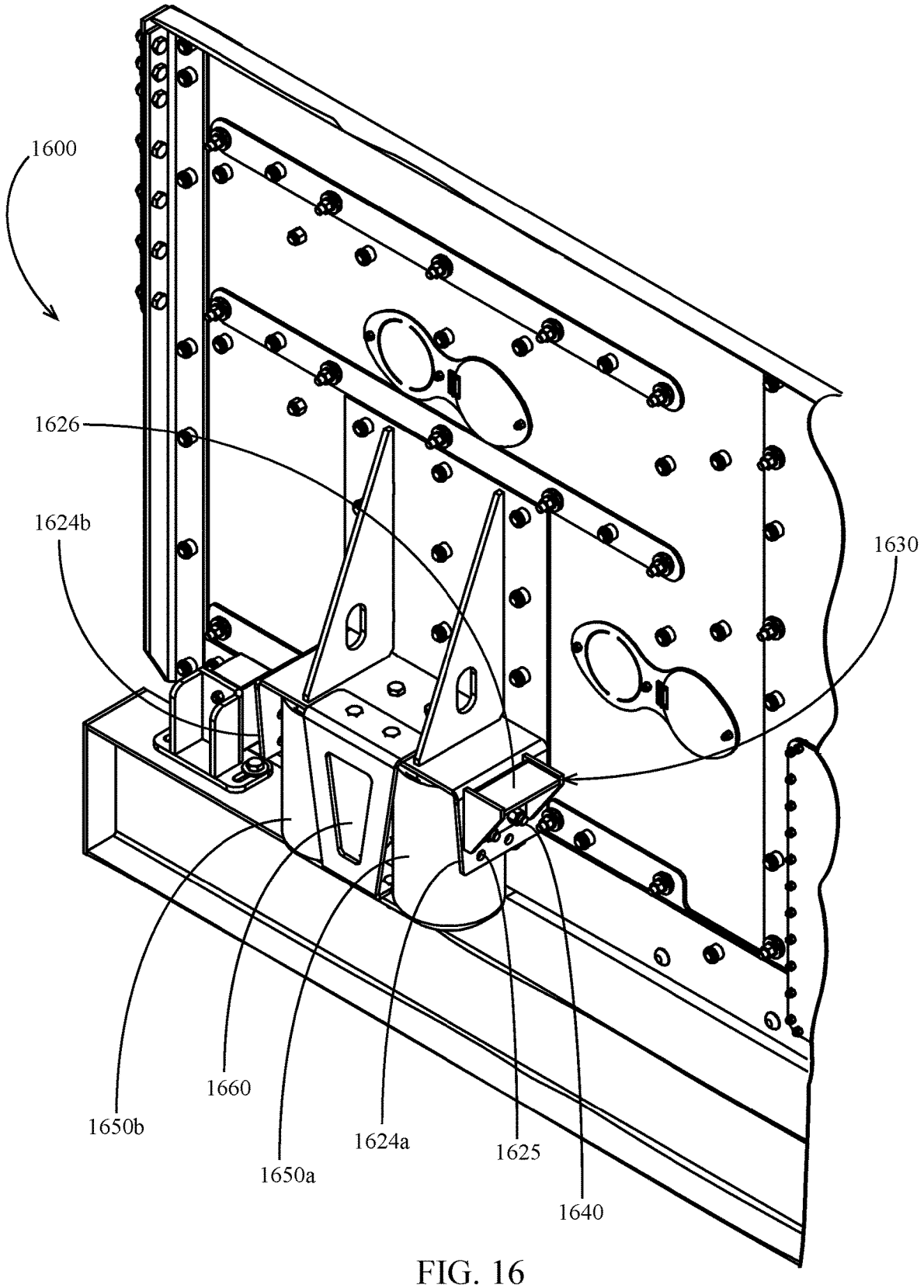
FIG. 16 is a perspective view of an embodiment of a spring suspension system of a vibratory screen.

Referring to FIG. 16, each of the sidewalls 720 of the vibratory screen 700 optionally includes a pair of spring suspension systems 1600 generally similar to the spring suspension systems 16 described earlier herein. A support assembly 1630 is optionally adjustably mounted to at least one of the downwardly extending sidewalls 1624*a*, 1624*b*. The support assembly 1630 optionally includes a support surface 1626 (e.g., a horizontal plate as illustrated) which is optionally sized and configured to support at least a portion of the weight of the vibratory screen 700 on a lifting device (e.g., lift jack) disposed between the support surface and a base such as a base member. The support surface 1626 optionally extends away from the remainder of spring suspension system 1600 (and/or from the sidewall 720) such that an open space is disposed vertically between the support surface 1626 and the base member 730 (and/or the ground). The open space is optionally sized to receive at least a portion of the lifting device (e.g., lift jack).

In some embodiments, the support assembly 1630 is adjustable. For example, the height of the support surface 1626 may be adjustable by selecting which of an array of vertically spaced holes 1625 in sidewall 1624 to which to fix the support assembly 1630 to the sidewall (e.g., using removable bolts 1640). The support assembly 1630 may also have two or more orientations (e.g., vertically flipped orientations); in a first orientation (e.g., the orientation illustrated in FIG. 16), the support surface 1626 is optionally disposed higher relative to the base member 730 (and/or the ground) than in the second orientation (e.g., an orientation vertically flipped from that illustrated in FIG. 16). The support surface 1626 is optionally disposed to provide a support surface for the lifting device (e.g., disposed generally horizontally) in both the first and second orientations.

In some embodiments, a maximum height to which the support surface 1626 may be adjusted relative to an upper surface base member 730 is approximately equal to a height of one of the springs of the spring suspension system 1600. The maximum height of the support surface 1626 relative to the ground may be approximately twice the height of the spring and/or approximately equal to the height of the spring plus a height of the base member 730.

In some embodiments, the support assembly and corresponding adjustable mounting structure described above may be mounted to other portions of the spring suspension system 1600 or to other structure on the vibratory screen 700 such as the sidewalls 720.

One or more brackets 1660 and/or other brackets may rigidly mount the base members 730 to the remainder of the vibratory screen 700 in a non-operational mode (e.g., during transport) secure the position of the vibratory screen 700 relative to the base members 730. The illustrated bracket 1660 optionally prevents the springs of the associated spring suspension system 1600 from being deformed by relative motion of the base member 730 and sidewall 720. After transport, the brackets 1660 and any other rigid links between the base members 730 and the remainder of the vibratory screen.

In the illustrated embodiment, first and second springs of the spring suspension system 1600 are substantially circumscribed by flexible (e.g., plastic) cylindrical sheaths 1650*a*, 1650*b* respectively.

Discharge Lip Embodiments

Figure 18:
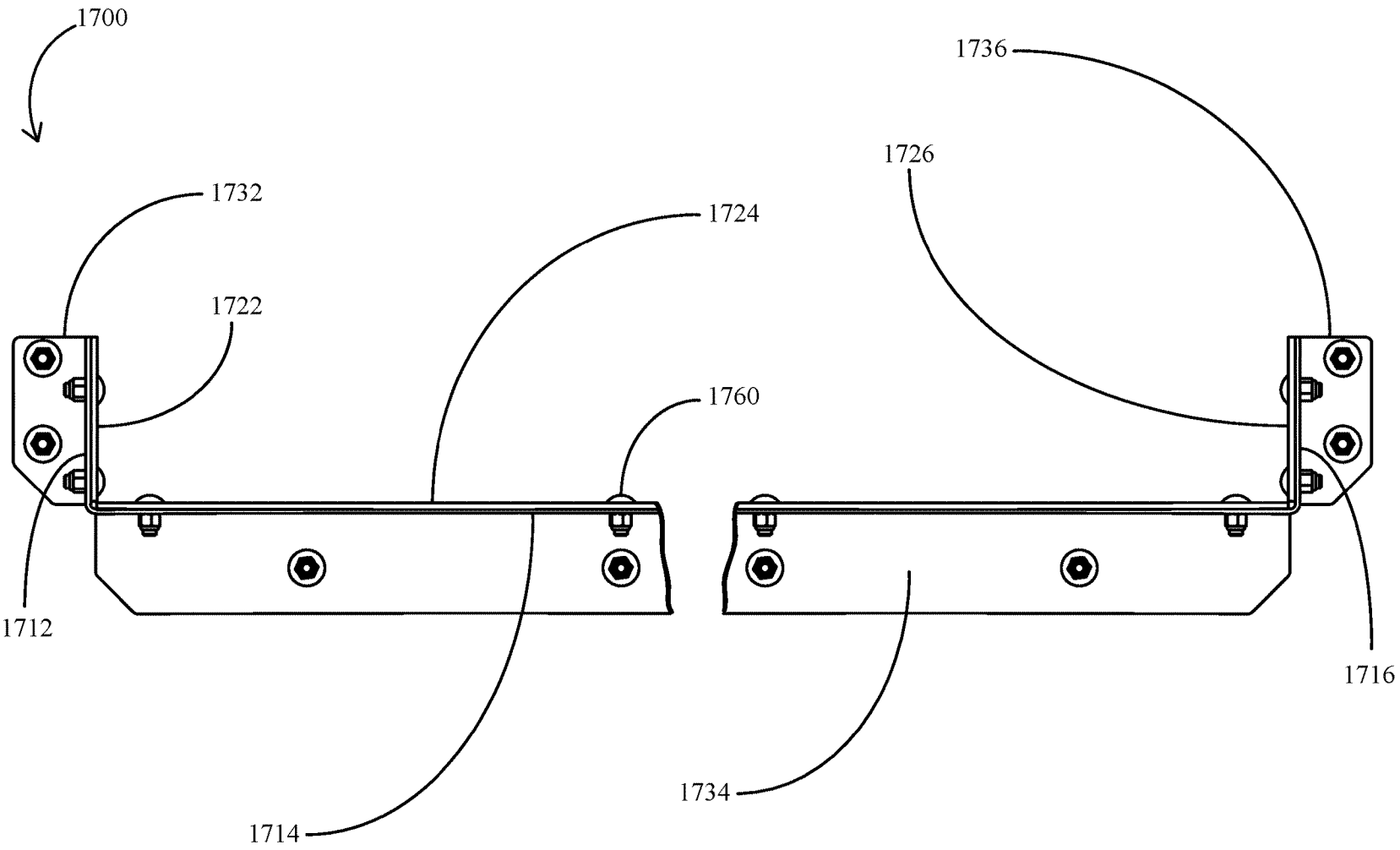
FIG. 18 is a rear elevation view of a discharge lip assembly of FIG. 17.

Turning to FIGS. 17 and 18, the decks 740*a*, 740*b*, 740*c* are each optionally associated with discharge lip assemblies 1700*a*, 1700*b*, 1700*c*, respectively. The discharge lip assemblies 1700 are optionally disposed at the outlet end 798 of the vibratory screen 700. Each discharge lip assembly 1700 is optionally disposed beyond the associated deck 740 along the direction D shown in FIG. 7. Each discharge lip assembly 1700 is optionally generally parallel to and disposed generally at the same height as (or slightly lower than) the associated deck 740. In some implementations, a discharge chute or chutes (not shown) may be fitted to one or more of the discharge lip assemblies 1700 in order to receive materials which pass from the outlet end 798. For example, a first discharge chute may be fitted to discharge lip assembly 1700*a* to receive materials passed from the outlet end 798 above the surface of deck 740*a*, while a second discharge chute may be fitted to discharge lip assembly 1700*b* to receive materials passed from the outlet end 798 above the surface of deck 740*b*; the first and second discharge chutes may direct the differently-sized materials to different locations (e.g., via conveyors and/or slides) for further processing.

Each discharge lip assembly 1700 is optionally mounted (e.g., bolted) to the screen 700. The discharge lip assembly 1700 optionally includes transversely extending flanges 1732, 1736 which are optionally mounted to forward surfaces 728 of the sidewalls 720-1, 720-2, respectively. The discharge lip assembly 1700 optionally includes a downwardly extending flange 1734 which is optionally mounted to a forward surface of the associated deck 740.

Each discharge lip assembly 1700 optionally comprises a floor 1714 disposed parallel to and at approximately the same height as the associated deck 740. Materials may pass over the floor 1714 as they are transferred off of the deck 740 (e.g., to a chute fitted to the discharge lip assembly). Each discharge lip assembly 1700 optionally comprises a pair of sidewalls 1712, 1716. Materials may pass adjacent to the sidewalls 1712, 1716 as they are transferred off of the deck 740. The floor 1714 and sidewalls 1712, 1716 optionally each comprise a metal such as steel.

Each discharge lip assembly 1700 optionally comprises a plurality of removable wear surfaces optionally having improved wear properties in comparison with the remainder of the discharge lip assembly 1700. As an example, wear plates 1722, 1724, 1726 may be removably mounted (e.g., bolted by bolts 1760) to sidewall 1712, floor 1714, and sidewall 1716 respectively. The wear plates 1722, 1724, 1726 optionally comprise flat plates and may be made of a wear-resistant material such as abrasion-resistant steel.

Access Panel Embodiments

Figure 19:
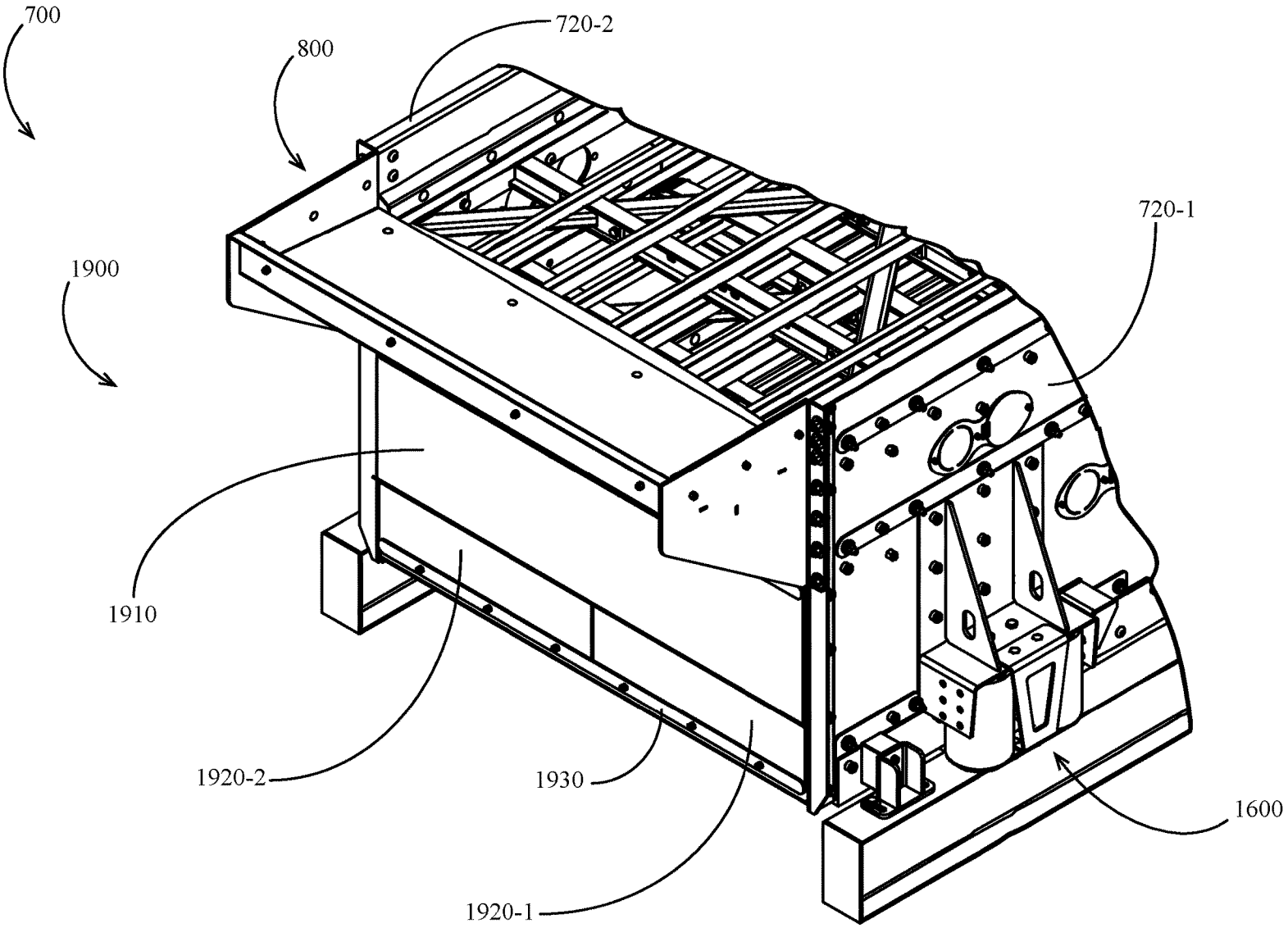
FIG. 19 is a perspective view of an embodiment of an access assembly of a vibratory screen.
Figure 20:
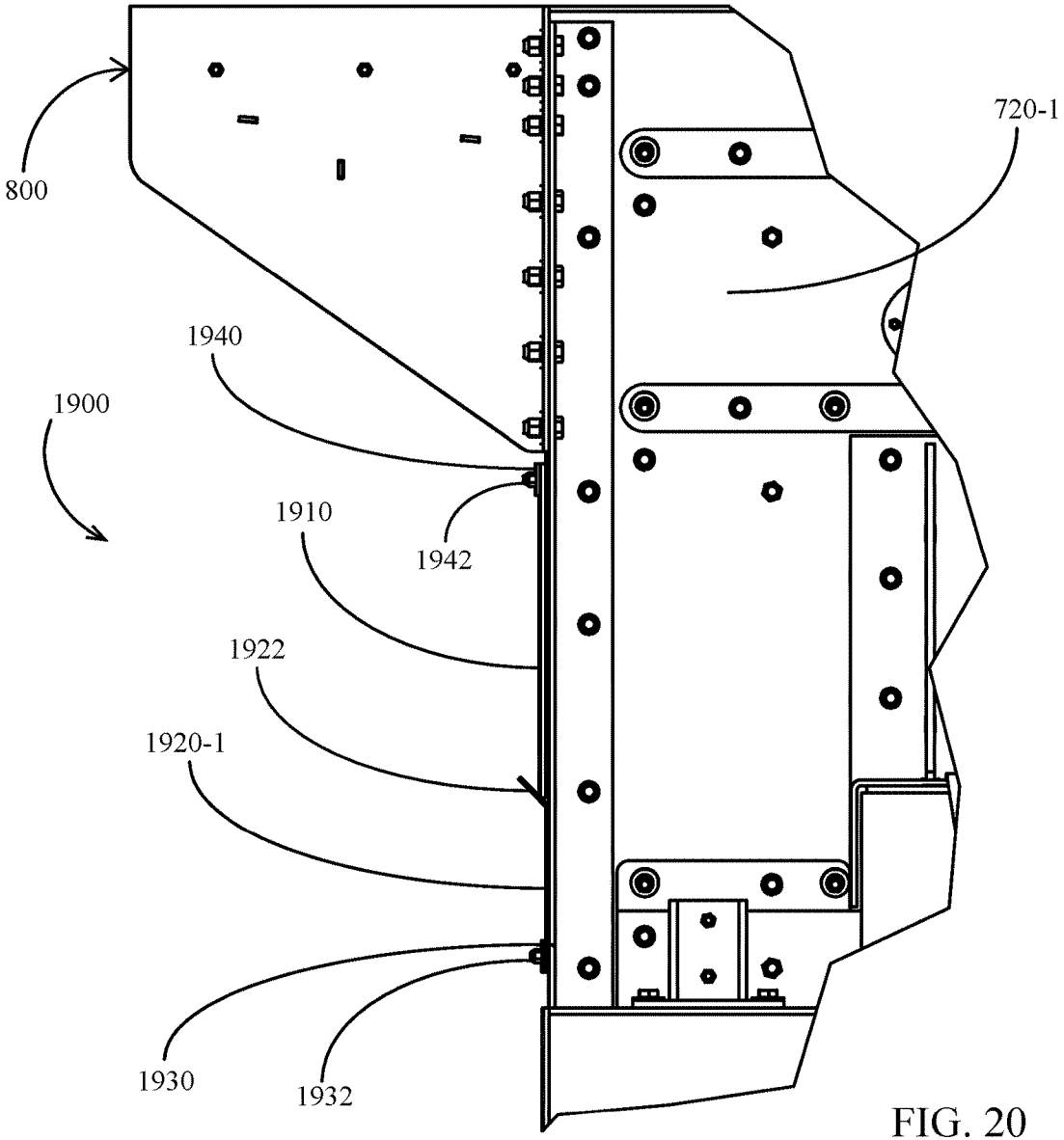
FIG. 20 is a side elevation view of the access assembly of FIG. 19.
Figure 21:
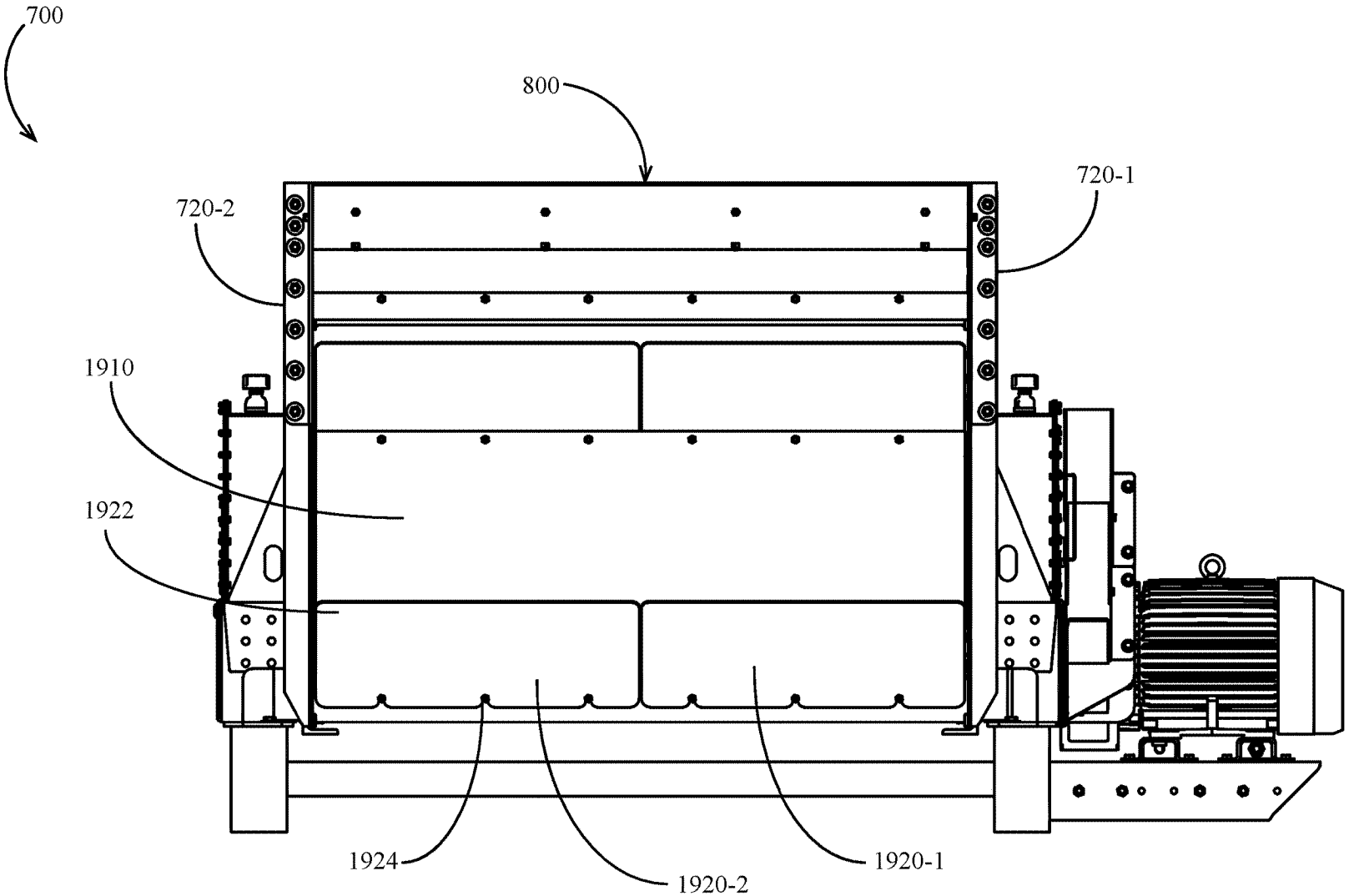
FIG. 21 is a rear elevation view of the access assembly of FIG. 19.
Figure 22:
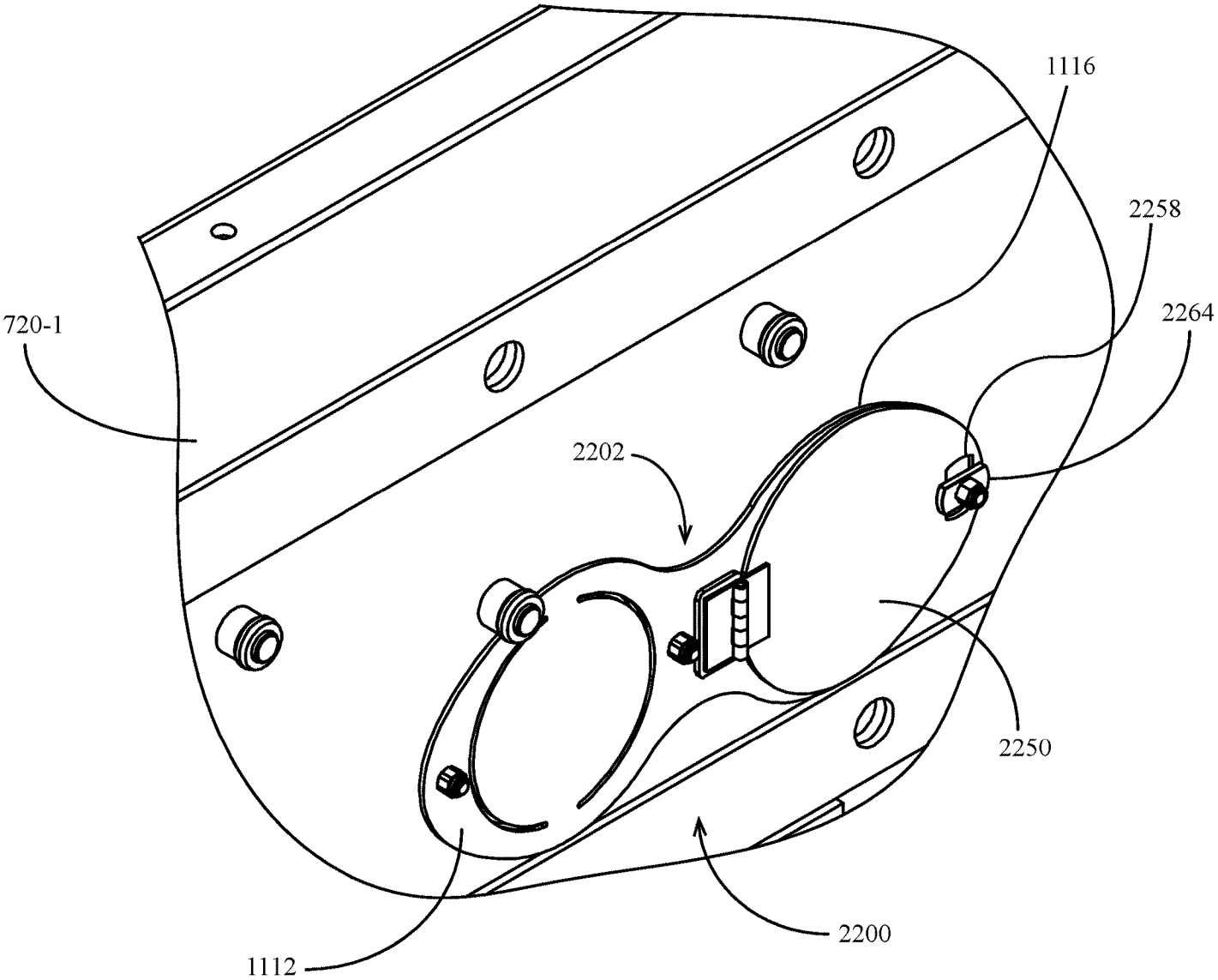
FIG. 22 is a partial perspective view of an embodiment of a vibratory screen having another embodiment of an access assembly in a closed configuration.
Figure 23:
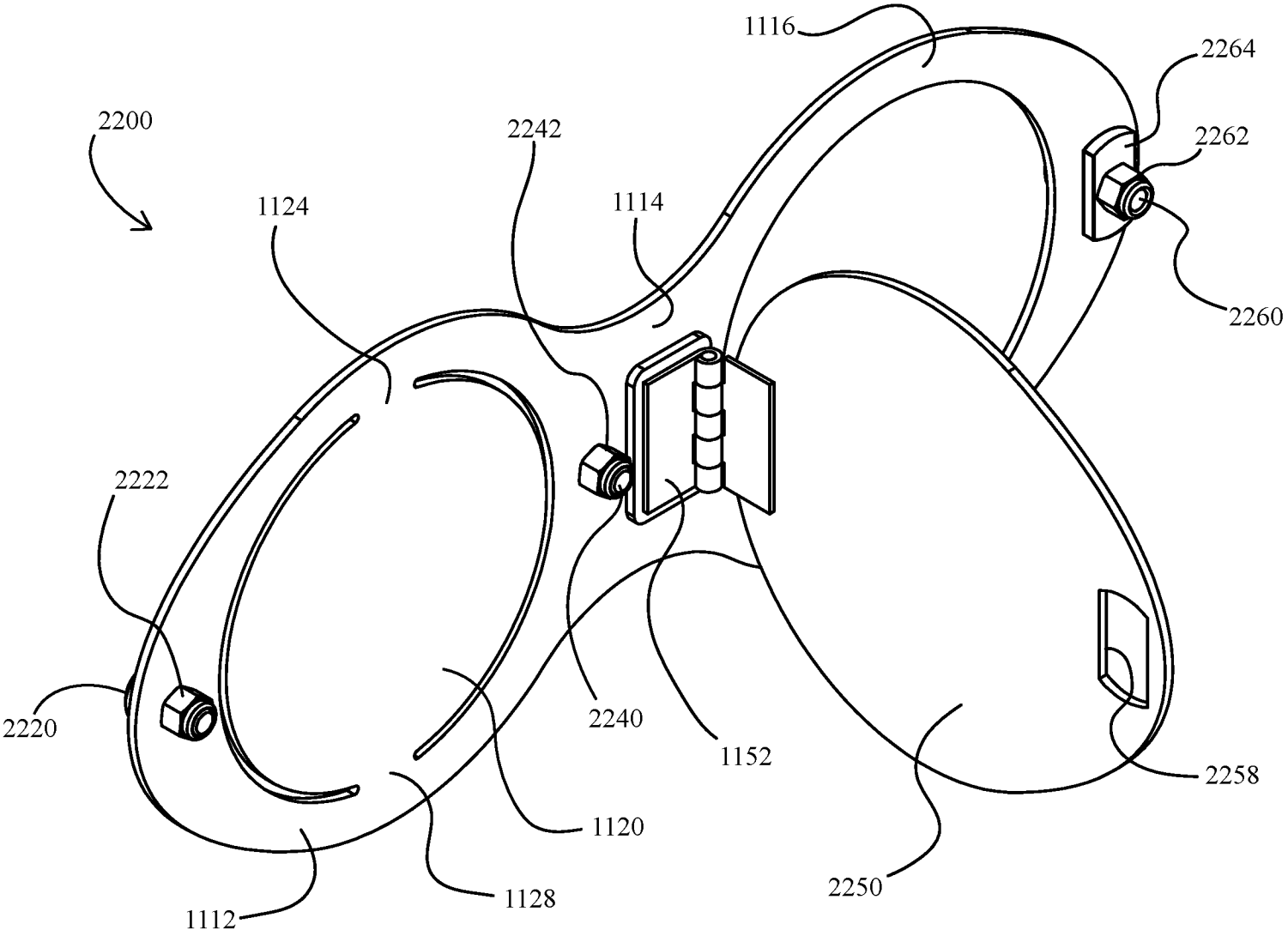
FIG. 23 is a perspective view of the access assembly of FIG. 22 in an open configuration.

Turning to FIGS. 19-21, the vibratory screen 700 optionally includes one or more access panels (e.g., rear access panels) for accessing the screens and decks from a rearward end of the vibratory screen.

In the illustrated embodiment, an access assembly 1900 comprises a plurality of removable panels which optionally cooperate to enclose a rear portion of the middle deck 740*b* and lower deck 740*c*. Some of the panels may have a width less than (e.g., approximately half) the width of the vibratory screen. Some of the panels may be removable without the complete removal of a fastener.

Removable panels 1920-1 and 1920-2 each optionally extend from a respective sidewall 720 of the screen 700 and optionally meet at a central plane in order to cover a portion (e.g., a lower portion as illustrated) of the rearward side of the screen 700. Although in the illustrated embodiment two panels 1920-1, 1920-2 are illustrated with each having a width approximately half the spacing between sidewalls 720, in other embodiments more panels 1920 having narrower widths may be employed to cover the lower portion of the rearward side of the screen 700. Removable panel 1910 optionally extends across the width of the spacing between sidewalls 720. Removable panel 1910 optionally covers a portion (e.g., central portion) of the vibratory screen. A lower edge of the panel 1910 is optionally disposed behind a rearwardly-angled lip 1922 of the panel 1910-1 and/or the panel 1910-2. The panels 1920 are optionally mounted to the remainder of screen 700 by removable fasteners such as a series of bolts 1932. A reinforcement panel 1930 is also optionally bolted to the panels 1910 by the bolts 1932. The panel 1910 is optionally mounted to the remainder of screen 700 by removable fasteners such as a series of bolts 1942. A reinforcement strip 1940 is also optionally bolted to the panel 1910 by the bolts 1942.

As is best illustrated in FIG. 21 (in which the reinforcement strips are not shown), each panel 1920 optionally has a series of notches 1924 along a lower edge thereof. In an installation mode, the panels 1920 are optionally secured by one or more of the steps of (1) partially installing the bolts 1932; (2) placing the panels 1920 into position such that the bolts 1932 are at least partially received in the notches 1924; (3) tightening the bolts 1932 in order to secure the upper edges of notches 1924 to the remainder of the screen 700. In a maintenance mode, the panels 1920 may be removed by one or more of the steps of (1) partially loosening (e.g., loosening but not removing) bolts 1932; and (2) lifting the panels 1920 (e.g., using the lip 1922) until the lower ends of notches 1924 is clear of the reinforcement panel 1930.

The various classifier embodiments described herein may comprise screens including horizontal screens, incline screens, dewatering screens, dry aggregate material screens, single-deck screens, multiple-deck screens, etc. The various classifier embodiments described herein may oscillate through any path (e.g., linear, circular, elliptical, etc.). The various classifier embodiments described herein may comprise self-standing units (e.g., stationary units or mobile units which may be mounted on wheels, skids or tracks, etc.). In other implementations, the various classifier embodiments described herein may be incorporated in plants (e.g., stationary plants or mobile plants which may be mounted on wheels, skids, or tracks, etc.) also incorporating other equipment such as conveyors, crushers, wet processing equipment (e.g., hydrocyclones, hydraulic sizers, etc.).

Although specific embodiments have been illustrated and described, it will be appreciated by those of ordinary skill in the art that a variety of alternate and/or equivalent implementations may be substituted for the specific embodiments shown and described without departing from the scope of the disclosure. This application is intended to cover any adaptations or variations of the specific embodiments of the support structures described herein. Therefore, it is intended that the specification is exemplary in nature, and that the scope of the invention is solely defined by the claims the equivalents thereof. For example, any feature described for one embodiment may be used in any other embodiment.

The following summarizes some of the various aspects of vibratory classifier embodiments and related components thereof disclosed herein:

1. A vibratory screen having a drive system, the drive system comprising a housing substantially enclosing a drive belt, the drive system being selectively openable to access a portion of said drive belt.
2. The vibratory screen of sub-paragraph 1, further comprising a tensioning assembly, the tensioning assembly being mounted at least partially within said housing.
3. A vibratory screen having a feedbox, wherein said feed box comprises a first surface disposed above a second surface, wherein the first surface is perforated, wherein the second surface is pivotable to create an opening, wherein a screen medium of the vibratory screen may be accessed through said opening.
4. A vibratory screen having a selectively openable access assembly.
5. The vibratory screen of sub-paragraph 4, wherein the access assembly includes a cover held in place by at least one tab, wherein removal of said at least one tab creates a generally circular opening in the access assembly.
6. The vibratory screen of sub-paragraph 5, wherein the access assembly includes a door disposed to cover an opening in a sidewall of the vibratory screen, wherein said door is pivotally connected to the vibratory screen, and wherein said opening is located above a deck of the vibratory screen.

7. A vibratory screen having an access assembly, wherein the access assembly comprises a plurality of removable panels arranged along a width of the vibratory screen.

8. The vibratory screen of sub-paragraph 7, wherein at least one of the removable panels comprises an edge having plurality of notches, the plurality of notches being retained in position relative to the vibratory screen by a removable fastener.

What is claimed is:

1. A vibratory classifier comprising:

a first sidewall defining a first plane;

a second sidewall defining a second plane, said first plane separated from said second plane by a distance along a transverse direction;

a vibratory mechanism supported at least partially on said first and second sidewalls, said vibratory mechanism configured to induce vibration of the classifier;

at least a first screen disposed at least partially between said first sidewall and said second sidewall, wherein upon vibration of the classifier, material moves along said first screen in at least a longitudinal direction generally perpendicular to said transverse distance;

a feed box disposed at least partially in an inlet region of the classifier, said inlet region disposed at least partially rearward of said first screen along said longitudinal direction, said feedbox comprising:

a classifying surface having openings therethrough; and a lower surface disposed at an angle below horizontal, said lower surface being disposed at least partially beneath said classifying surface to receive undersize material that passes through said classifying surface, said lower surface being disposed to transfer said undersize material onto said first screen, wherein said lower surface is pivotable between an operating position and a maintenance position; wherein in said maintenance position an access opening is disposed between said lower surface and said classifying surface, wherein said access opening permits access to a rear portion of said first screen.

2. The vibratory classifier of claim 1, wherein said feedbox further comprises:

first and second transversely spaced feedbox walls, wherein said lower surface is pivotally coupled to each of said feedbox walls.

3. The vibratory classifier of claim 2, wherein said feedbox further comprises:

a link, wherein said link at least partially supports said lower surface in said maintenance position.

4. The vibratory classifier of claim 3, wherein said link comprises a slotted link.

5. The vibratory classifier of claim 3, wherein said link is disposed adjacent to one of said first and second feedbox walls.

6. The vibratory classifier of claim 1, wherein said feedbox further comprises:

a link, wherein said link at least partially supports said lower surface in said maintenance position.

7. The vibratory classifier of claim 1, further comprising:

a second screen disposed above said first screen, said first screen at least partially supported by said first and second sidewalls.

8. The vibratory classifier of claim 7, wherein said classifying surface is disposed adjacent to and rearwardly of said second screen.

9. The vibratory classifier of claim 7, wherein said classifying surface is disposed to transfer oversize material onto said second screen.

10. A method of operating a material classifier, comprising:

in an operational mode:

receiving material onto a classifying surface of a feedbox;

transferring a first material subset comprising oversize material passing over said classifying surface onto a first classifying screen adjacent to said feedbox;

receiving a second material subset comprising undersize material passing through said classifying surface onto a lower surface disposed at least partially beneath said classifying surface;

transferring said second material subset across said lower surface onto a second classifying screen adjacent to said feedbox;

in a maintenance mode:

pivoting said lower surface from an operating position downward into a maintenance position to create an access opening between said classifying surface and said lower surface; and accessing said second classifying screen via said access opening.

11. The method of claim 10, further comprising:

selectively locking and unlocking said lower surface in said operating position.

12. The method of claim 10, further comprising:

by a link coupled to a sidewall of the feedbox, at least partially supporting said lower surface in said maintenance position.

* * * * *